US006237485B1

(12) United States Patent
Fukai

(10) Patent No.: US 6,237,485 B1
(45) **Date of Patent: *May 29, 2001**

(54) STENCIL PRINTER HAVING PAPER SUPPLY CONTROLLER

(75) Inventor: Shigeki Fukai, Ibaraki-ken (JP)

(73) Assignee: Riso Kagaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,573

(22) Filed: Aug. 30, 1999

(30) Foreign Application Priority Data

Aug. 31, 1998 (JP) ..... 10-245051

(51) Int. Cl.[7] ..... B41L 13/06; B41J 13/00

(52) U.S. Cl. ..... 101/118; 101/484; 101/232; 271/256; 271/258.02; 400/637.1; 400/636; 400/708

(58) Field of Search ..... 101/114, 116, 101/117, 118, 129, 232, 484; 271/256, 258.01, 258.02, 259, 265.01; 400/708, 624, 629, 636, 637, 637.1, 582

(56) References Cited

U.S. PATENT DOCUMENTS 4,628,813 * 12/1986 Hasegawa et al. ..... 101/116
4,791,866 * 12/1988 Kanno et al. ..... 101/118
5,483,878 * 1/1996 Hanzawa ..... 101/118
5,544,579 * 8/1996 Gallagher et al. ..... 400/582
5,544,580 * 8/1996 Takahashi ..... 101/118
5,580,046 * 12/1996 Beaufort et al. ..... 271/265.02
5,639,171 * 6/1997 Brewster, Jr. et al. ..... 400/708
5,890,708 * 4/1999 Song ..... 271/10.03
5,979,311 * 11/1999 Kakurai et al. ..... 101/118

FOREIGN PATENT DOCUMENTS 0 607 669 A1 7/1994 (EP) .
2 268 446 1/1994 (GB) .
6-11834 7/1990 (JP) .
3-193383 8/1991 (JP) .

* cited by examiner

*Primary Examiner*—John S. Hilten
*Assistant Examiner*—Leslie J. Grohusky
(74) *Attorney, Agent, or Firm*—Nixon Peabody LLP; Donald R. Studebaker

(57) ABSTRACT

A stencil printer includes a printing drum which is rotated bearing thereon a stencil master, and a press roller which is pressed against the printing drum. A paper supply system supplies a printing paper to between the printing drum and the press roller so that the printing paper is conveyed pinched between the printing drum and the press roller. A paper supply controller controls the paper supply system so that the paper supply system supplies the printing paper to between the printing drum and the press roller at a first predetermined angular position of the printing drum for each rotation of the printing drum. The paper supply controller controls the paper supply system so that the printing paper supplied next by the paper supply system does not collide with the printing paper under printing when the printing paper is overlong.

13 Claims, 28 Drawing Sheets

STENCIL PRINTER HAVING PAPER SUPPLY CONTROLLER

BACKGROUND OF THE INVENTION

1. Field of the Invention

This invention relates to a stencil printer, and more particularly to control of paper supply to a stencil printer.

2. Description of the Related Art

There has been known a stencil printer in which a stencil master is wound around a printing drum and a printing paper is supplied between the printing drum and a press roller which are rotated in contact with each other so that ink supplied inside the printing drum is transferred to the printing paper through the imagewise perforations in the stencil master while the printing paper is conveyed pinched between the printing drum and the press roller.

In such a stencil printer, it is required that the printing paper is supplied between the printing drum and the press roller so that the printing paper is accurately positioned with respect to the stencil master wound around the printing drum. For this purpose, in a conventional stencil printer, paper supply, paper conveyance, printing and paper discharge are effected for each rotation of the printing drum by use of gear mechanisms and/or cam mechanisms which are driven by rotation of the printing drum.

More specifically, the conventional stencil printer comprises a primary paper supply section which feeds out printing papers one by one from a stack of printing papers on a paper supply table, a secondary paper supply section which is provided with a timing roller pair which feeds the printing paper received from the primary paper supply section to between a printing drum and a press roller, a printing section which supplies ink from an ink supply section inside the printing drum to the printing paper which is conveyed pinched between the printing drum and the press roller so that the ink is transferred to the printing paper through a stencil master, and a paper discharge section which discharges the printing paper from the printing drum after printing. A series of actions, paper supply, paper conveyance, printing and paper discharge, are timed on the basis of a detected angular position of the printing drum and a detected position of the printing paper.

In such a conventional stencil printer, printing on one printing paper is done in one rotation of the printing drum irrespective of the length of the printing paper (the dimension as measured in the direction of conveyance of the printing paper). Accordingly, the permissible maximum length of a printing paper basically depends on the circumference of the printing drum, and since the printing actions including paper supply, paper conveyance, printing and paper discharge are controlled detecting the angular position of the printing drum and the position of the printing paper, the permissible maximum length of a printing paper is generally slightly smaller than the circumference of the printing drum.

Recently, there has been a demand for a stencil printer which can print on printing papers which are longer than the permissive maximum length (will be referred to as "overlong printing paper", hereinbelow). In such a case, printing is made only on a part of the printing paper. When printing is to be made on such overlong printing papers, the printing drum completes one rotation before the printing paper is completely discharged from the printing drum, and accordingly, the paper supply action for the next printing paper must be initiated before the preceding printing paper is completely discharged from the printing drum. That is, supply of the next printing paper must be initiated while the trailing end portion of the preceding printing paper is still between the pair of timing rollers or between the printing drum and the press roller.

In the conventional stencil printers, the primary and secondary paper supply sections are generally arranged to convey the printing paper at a speed higher than that at which the printing paper is conveyed by the printing drum and the press roller, and accordingly when supply of a next printing paper is initiated while the trailing end portion of the preceding printing paper is still between the pair of timing rollers or between the printing drum and the press roller, the leading end portion of the next printing paper can collide with the trailing end portion of the preceding printing paper, thereby causing paper jam and the like.

SUMMARY OF THE INVENTION

In view of the foregoing observations and description, the primary object of the present invention is to provide a stencil printer which can continuously make print on overlong printing papers without trouble.

In accordance with the present invention, there is provided a stencil printer comprising a printing drum which is rotated bearing thereon a stencil master, a press roller which is pressed against the printing drum, a paper supply means which supplies a printing paper to between the printing drum and the press roller so that the printing paper is conveyed pinched between the printing drum and the press roller, and a paper supply control means which controls the paper supply means so that the paper supply means supplies the printing paper to between the printing drum and the press roller at a first predetermined angular position of the printing drum for each rotation of the printing drum, wherein the improvement comprises that a paper length input means generates a paper length signal representing that the printing paper is an overlong printing paper which is larger than a standard length in a length as measured in the direction of conveyance of the printing paper, and said paper supply control means controls the paper supply means, when the paper length input means generates the paper length signal, so that the printing paper supplied next by the paper supply means does not collide with the printing paper under printing.

In this specification, the term "standard length" means the permissible maximum length of a printing paper which can be printed by one rotation of the printing drum and basically depends on the structure of the printing drum, the paper supply mechanism, the paper conveying mechanism and the like.

The paper supply control means may control the paper supply means in any manner when the paper length input means generates the paper length signal provided that the printing paper supplied next by the paper supply means does not collide with the printing paper under printing. For example, the paper supply control means may control the paper supply means when the paper length input means generates the paper length signal so that the paper supply means does not initiate paper supply until the preceding printing paper is completely discharged, so that the paper supply means initiates the paper supply later than the normal timing, or so that the paper supply means conveys the next printing paper at a speed lower than that at which the preceding printing paper is conveyed during printing.

In one embodiment, the paper supply control means inhibits the paper supply means from supplying the next printing paper while the printing paper under printing is being conveyed through the printing drum and the press roller.

In another embodiment, said paper supply means comprises a primary paper supply section which feeds out the printing paper from a stack of the printing papers at a fourth predetermined angular position of the printing drum and a secondary paper supply section comprising a pair of timing rollers which supplies the printing paper fed from the first paper supply section to between the printing drum and the press roller at the first predetermined angular position of the printing drum, and said paper supply control means inhibits the primary paper supply section from feeding out the next printing paper at the fourth predetermined angular position of the printing drum while the printing paper under printing is being conveyed through the pair of timing rollers.

When the paper supply means comprises the timing rollers, the paper length input means may comprise a paper detecting means which detects whether the printing paper exists near the pair of timing rollers at a predetermined timing, and a signal input means which generates a paper length signal representing that the printing paper is an overlong printing paper when the paper detecting means detects that the printing paper exists near the pair of timing rollers at the predetermined timing.

Generally the paper length input means may comprise a paper detecting means which detects whether the printing paper exists near the contact line between the printing drum and the press roller at a predetermined timing, and a signal input means which generates a paper length signal representing that the printing paper is an overlong printing paper when the paper detecting means detects that the printing paper exists near the contact line between the printing drum and the press roller at the predetermined timing.

Further the paper length input means may comprise a paper size detecting means which detects the size of printing papers on a paper supply table, and a signal input means which generates a paper length signal representing that the printing paper is an overlong printing paper on the basis of the output of the paper size detecting means.

Further the paper length input means may comprise a paper size input means for inputting the size of printing papers, and a signal input means which generates a paper length signal representing that the printing paper is an overlong printing paper when the paper size input through the paper size input means indicates that the length of the printing papers is longer than the standard length.

In accordance with the present invention, the conventional stencil printer can be modified so that it can continuously make print on overlong printing papers by simply changing control of the paper supply mechanism without changing the mechanism of the stencil printer.

DESCRIPTION OF THE PREFERRED EMBODIMENT

Figure 1:
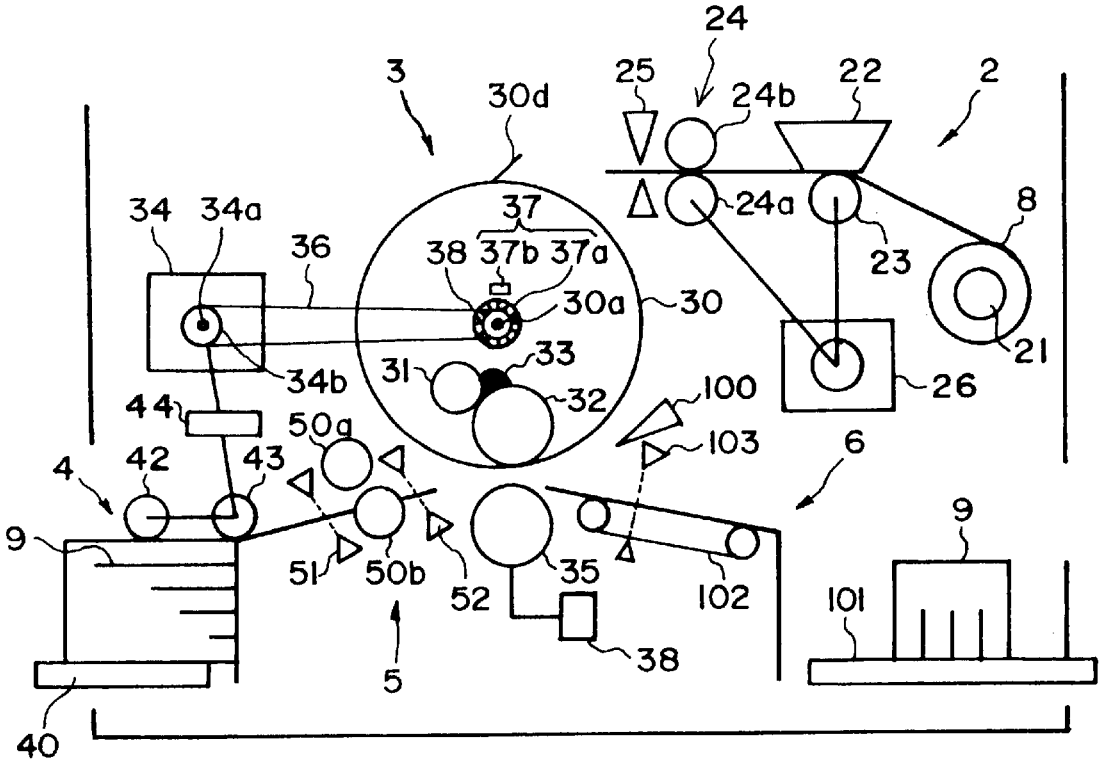
FIG. 1 is a schematic side view of a stencil printer in accordance with an embodiment of the present invention.

In FIG. 1, a stencil printer in accordance with an embodiment of the present invention comprises a printing section 3, a stencil master making section 2, first and second paper supply section 4 and 5, and a paper discharge section 6. A printing drum 30 forms a main part of the printing section 3.

The stencil master making section 2 comprises a master material source 21 in which a roll of stencil master material 8 in a continuous length is stored, a thermal head 22 which has a plurality of heater elements, a platen roller 23 which conveys the stencil master material 8 pressing the material 8 against the thermal head 22, thereby perforating the stencil master material 8 according to an image to be printed, a stencil master material conveyance roller pair 24 which consists of a stencil master material conveyance roller 24*a* and a guide roller 24*b* and conveys the stencil master material 8 bearing thereon the imagewise perforations toward the printing drum 30, and a cutter means 25 which cuts the part of the stencil master material 8 bearing the imagewise perforations from the stencil master material 8 in continuous length. The stencil master which is obtained by cutting the part of the stencil master material 8 bearing the imagewise perforations will be also denoted by reference numeral 8 for the purpose of simplicity, hereinbelow.

The stencil master material may be of a known structure such as formed of thermoplastic film alone or formed of laminated film of thermoplastic film and porous base material.

The platen roller 23 and the stencil master material conveyance roller 24*a* are driven by a write motor 26 to convey the stencil master material toward a clamp mechanism 30*d* on the printing drum 30.

The cutter means 25 cuts off the stencil master 8 when the stencil master material is wound around the printing drum 30 by a predetermined length.

Image data representing an original image read by an image reading means (not shown) such as a line image sensor is input into the stencil master making section 2. The heater elements of the thermal head 22 are selectively energized according to the input image data to imagewise perforate the stencil master material 8 according to the input image data.

The printing section 3 comprises the printing drum 30 which has a cylindrical and ink-permeable side wall, a main motor 34 which drives the printing drum 30 and a press roller 35 which presses a printing paper 9 conveyed by the secondary paper supply section 5 against the side wall of the printing drum 30. An ink supply section comprising a doctor roller 31 and a squeegee roller 32 is disposed inside the printing drum 30. A predetermined amount of ink 33 is supplied to the inner surface of the side wall of the printing drum 30 from an ink fountain formed between the doctor roller 31 and the squeegee roller 32.

The main motor 34 drives the printing drum 30 by way of a drive gear 34*b* provided on an output shaft 34*a* of the main motor 34, a sprocket 38 formed on a rotary shaft of the printing drum 30 and an endless belt 36 wound around the drive gear 34*b* and the sprocket 38.

A drum position detecting means 37 comprising a drum encoder 37*a* and a photosensor 37*b* outputs information on the angular position of the printing drum 30 (the angle by which the printing drum 30 is rotated from a reference position).

A clamp mechanism 30*d* which clamps the leading end of the stencil master 8 so that the stencil master 8 is wound around the printing drum 30 as the printing drum 30 is rotated is provided on the side wall of the printing drum 30. A reference position sensor (not shown) which detects a reference position of the printing drum 30, e.g., the leading end of the stencil master 8 is provided near the clamp mechanism 30*d* separately from the printing drum 30.

In the printing section 3, the printing paper 9 conveyed from the secondary paper supply section 5 is pinched between the printing drum 30 and the press roller 35 and conveyed. While the printing paper 9 is conveyed by the printing drum 30 and the press roller 35, ink is supplied from the ink supply section to the inner surface of the side wall of the printing drum 30 and transferred to the printing paper 9 through the imagewise perforations of the stencil master 8.

Since the clamp mechanism 30*d* projects outward from the surface of the side wall of the printing drum 30, a press roller retracting mechanism 38 is provided to move the press roller 35 away from the printing drum 30 so that the clamp mechanism 30*d* on the printing drum 30 does not interfere with the press roller 35.

Figure 2:
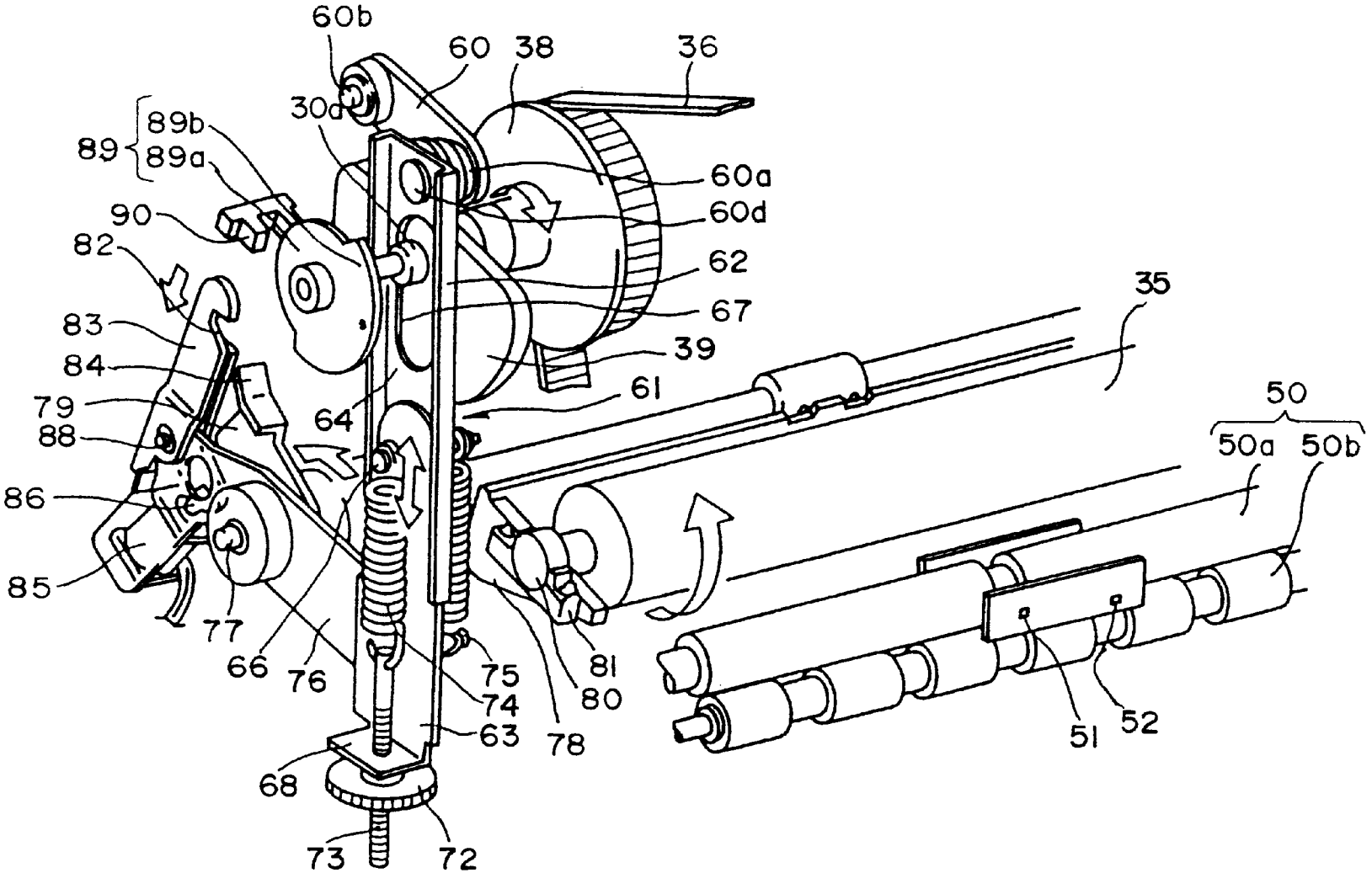
FIG. 2 is a fragmentary perspective view of a press roller drive mechanism of the stencil printer.
Figure 3:
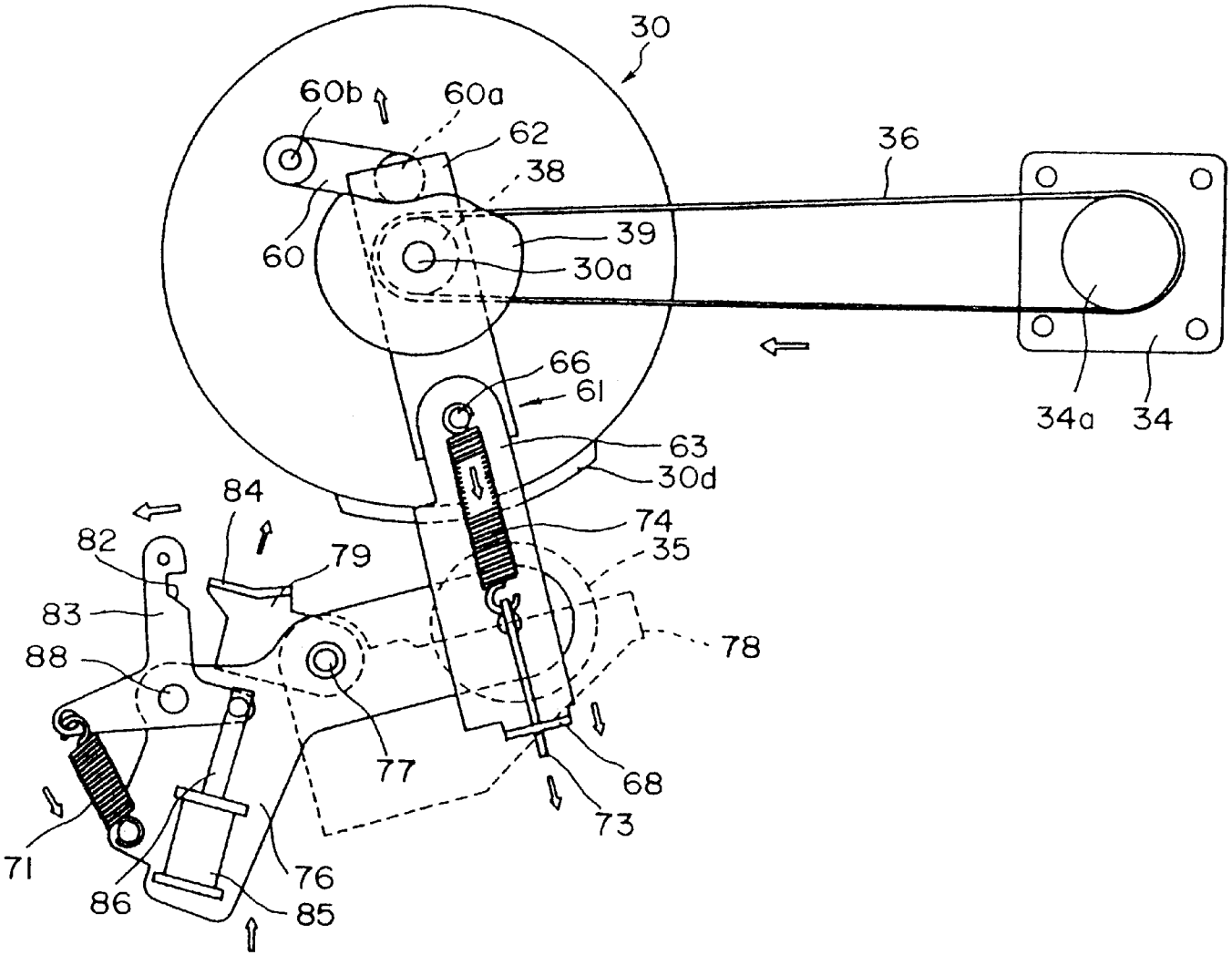
FIG. 3 is a schematic side view showing the press roller in the inoperative position.
Figure 4:
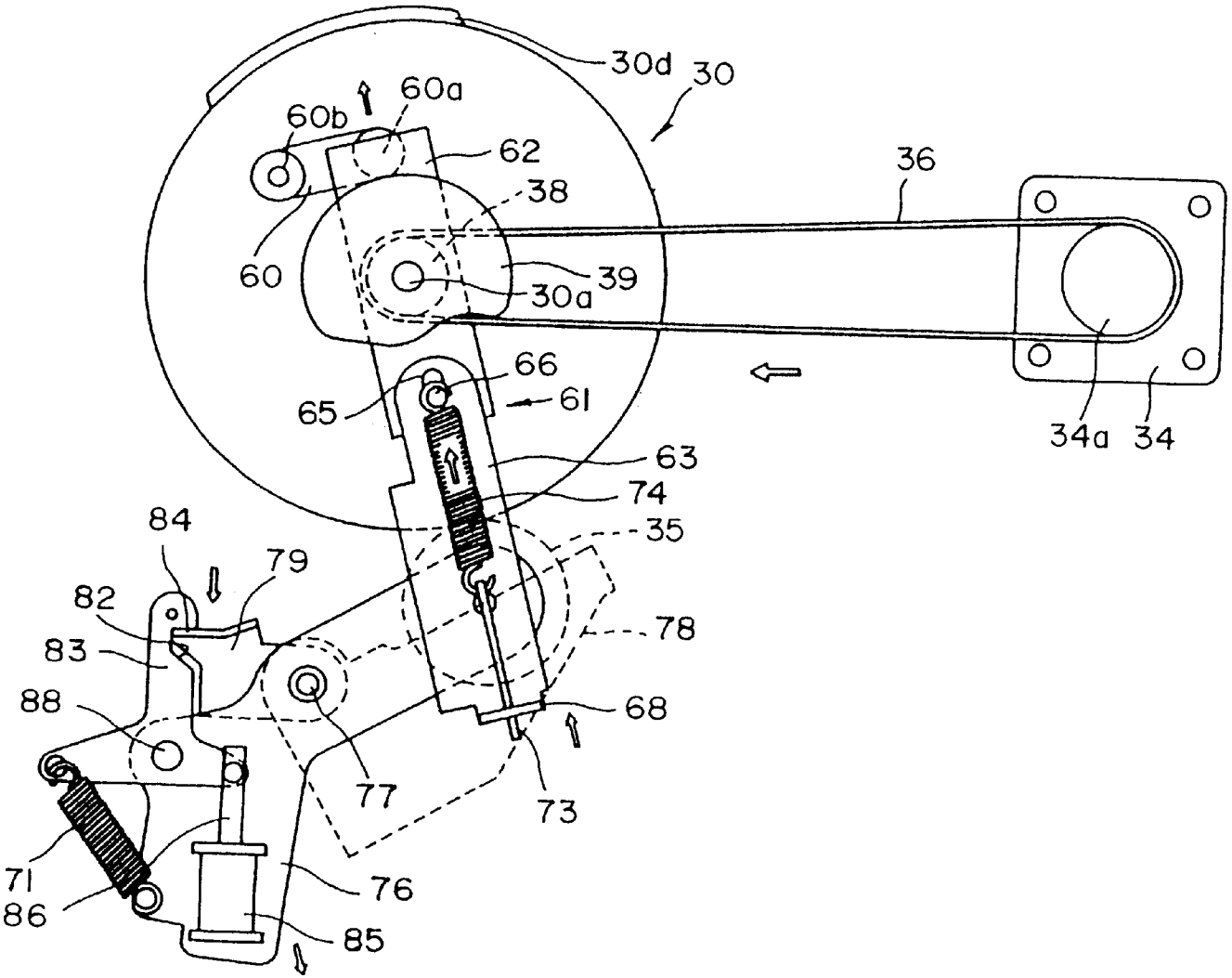
FIG. 4 is a schematic side view showing the press roller in the operative position.

The structure of the press roller retracting mechanism 38 will be described with reference to FIGS. 2 to 5, hereinbelow. In FIGS. 2 to 5, the printing drum 30 is driven by the main motor 34 by way of the sprocket 38 formed coaxially with the rotary shaft 30*a* thereof, the endless belt 36 and the drive gear 34*b* on the output shaft 34*a* of the main motor 34 as described above. With this arrangement, the printing drum 30 is rotated intermittently or continuously in the clockwise direction as seen in FIGS. 3 and 4.

An eccentric press cam 39 is mounted on the rotary shaft 30*a* of the printing drum 30 on the outer side of the sprocket 38 to be rotated together with the printing drum 30. The eccentric press cam 39 has a cam surface having an elevated portion and a recessed portion. A cam follower lever 60 one end of which is mounted for rotation on a frame (not shown) of the stencil printer by way of a pin 60*b* is in contact with the cam surface of the cam 39. The cam follower lever 60 is further connected to a link member 61 at the other end thereof by way of a pin 60*d* (FIG. 2) of a bearing 60*a* and is urged downward as seen in FIG. 2 by a spring not shown.

The link member 61 comprises upper and lower links 62 and 63 which are plate-like members. The upper link 62 is connected to the cam follower lever 60 by way of the pin 60*d* of the bearing 60*a* The upper link 62 is provided with a channel 64 and the lower link 63 is slidably fitted in the channel 64.

The link member 61 is telescopic in its longitudinal direction. That is, the overall length of the link member 61 is changed by sliding the lower link 63 relatively to the upper link 62 in the channel 64. The lower link 63 is provided with an elongated opening 65 (FIGS. 4 and 5) and a pin 66 fixed to the upper link 62 is inserted into the elongated opening 65, whereby the amount by which the overall length of the link member 61 is variable is limited.

The upper link 62 is provided with an elongated opening 67 for preventing interference with the rotary shaft 30*a* of the printing drum 30, whereby the link member 61 can be moved up and down in response to rotation of the press cam 39.

The lower end portion of the lower link 63 is bent in a L-shape and forms a support portion 68. Though not shown, a pulse motor and a reduction unit which reduces the output of the pulse motor are supported on the support portion 68. Reference numeral 72 denotes a large diameter gear which is in mesh with a gear mounted on the output shaft of the pulse motor and forms a part of the reduction unit.

A threaded control rod 73 extends through the center of the large diameter gear 72 and is in mesh with the support portion 68 of the lower link 63. A coiled tension spring 74 is mounted between the pin 66 fixed to the upper link 62 and the upper end of the control rod 73 and urges upward (as seen in FIG. 2) the lower link 63 with respect to the upper link 62.

As shown in FIG. 2, an end of a rotatable lever 76 is connected to the lower link 63 by a pivot 75. The rotatable lever 76 is supported for rotation by a pivot 77 on the frame of the stencil printer at its middle portion. One ends of a connecting plate 78 and a connecting lever 79 are coaxially connected to the pivot 77. A bracket 81 which supports for rotation the rotary shaft 80 of the press roller 35 is mounted on the connecting plate 78. A hook lever 83 provided with a key groove 82 is mounted on the other end of the rotatable lever 76. An engagement portion 84 which is adapted to be engaged with the key groove 82 of the hook lever 83 is formed on the free end of the connecting lever 79. With this arrangement, the rotatable lever 76 and the connecting lever 79 are drivingly connected to each other in response to counterclockwise (as seen in FIG. 2) rotation of the rotatable lever 76.

A coiled tension spring 71 is mounted between the hook lever 83 and the rotatable lever 79 and urges the hook lever 83 in the counterclockwise direction (as seen in FIGS. 3 and 4) with respect to the rotatable lever 76, i.e., the direction in which the hook lever 83 is disengaged from the rotatable lever 76 as shown in FIG. 3.

A press solenoid 85 is mounted on the rotatable lever 76 and the hook lever 83 is mounted for rotation on the rotatable lever 76 by a pivot 88. The press solenoid 85 has a drive shaft 86 which is connected to one end of the hook lever 83. When the press solenoid 85 is turned on and the drive shaft 86 is moved upward, the hook lever 83 is rotated in the clockwise direction as seen in FIGS. 3 and 4 and the key groove 82 of the hook lever 83 is brought into engagement with the engagement portion 84 of the connecting lever 79, whereby the rotatable lever 76 and the connecting lever 79 are drivingly connected to each other as shown in FIG. 4.

As shown in FIG. 2, a detecting disc 89 for detecting a timing at which the press solenoid 85 is to be turned off is mounted on one end of the rotary shaft 30*a* of the printing drum 30. The detecting disc 89 has a small diameter portion 89*a* and a large diameter portion 89*b* which respectively extend over 180°. A press sensor 90 in the form of a photo-interrupter is disposed near the detecting disc 89 so that the large diameter portion 89*b* of the detecting disc 89 interrupts a light beam while the press roller 35 is in contact with the printing drum 30 and printing is effected. Further the detecting disc 89 is mounted on the rotary shaft 30*a* of the printing drum 30 in a position where the large diameter portion 89*b* interrupts the light beam of the press sensor 90 while a second paper supply sensor 62 to be described later is detecting a printing paper 9.

Figure 6:
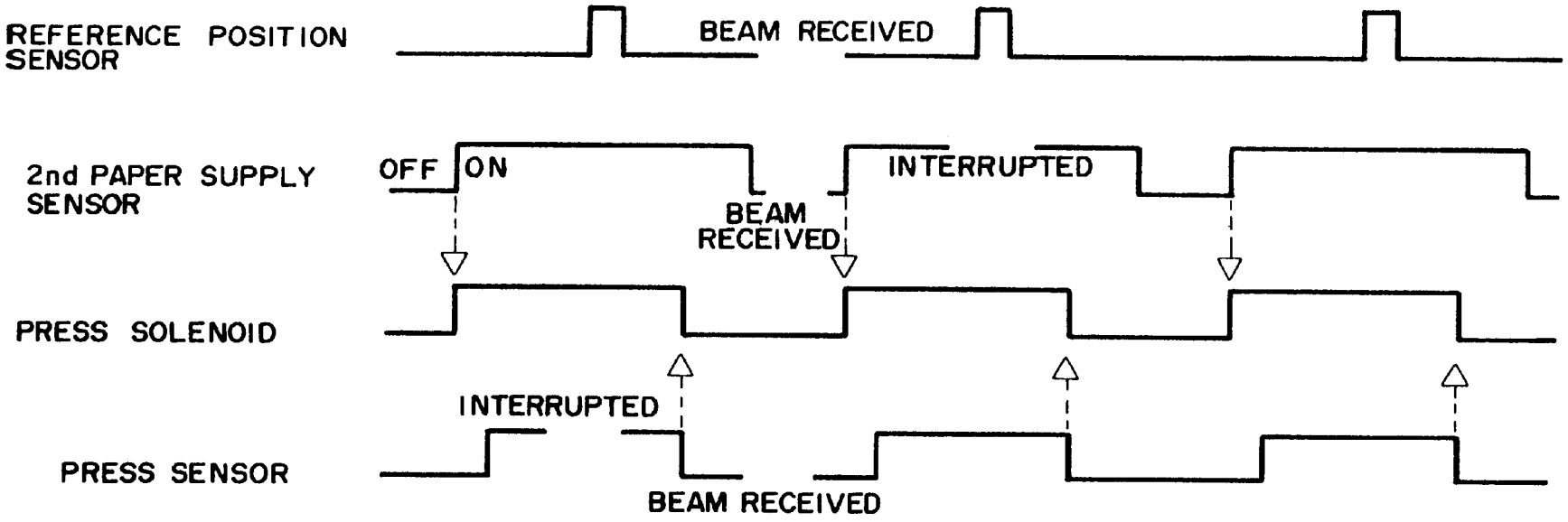
FIG. 6 is a timing chart showing the action of the press solenoid during printing.

FIG. 6 is a timing chart showing the action of the press solenoid 85 while printing is effected. As shown in FIG. 6, when a light beam for the second paper supply sensor 52 is interrupted, that is, when a printing paper 9 is detected, the press solenoid 85 is turned on. Further when the press sensor 90 comes to receive a light beam, that is, when printing on one printing paper 9 is ended, the press solenoid 85 is turned off.

In the press roller retracting mechanism described above, the link member 61 is in a lower position and the press roller 35 is held away from the printing drum 30 when the eccentric press cam 39 is in the position shown in FIGS. 2 and 3. The position of the press cam 39 shown in FIGS. 2 and 3 will be referred to as "the retracting position" and the position of the press roller 35 shown in FIGS. 2 and 3 will be referred to as "the inoperative position", hereinbelow.

When the printing drum 30 and the rotary shaft 30*a* thereof are rotated by 180° in the clockwise direction from the state shown in FIGS. 2 and 3, the eccentric press cam 39 is also rotated by 180° in the clockwise direction, whereby the link member 61 is moved upward and the rotatable lever 76 is rotated in the counterclockwise direction as seen in FIG. 3 about the pivot 77.

When the press solenoid 85 is turned on and the hook lever 83 is rotated in the clockwise direction at this time, the engagement portion 84 of the connecting lever 79 is brought into engagement with the key groove 82 of the hook lever 83 and rotation of the rotatable lever 76 comes to be transmitted to the connecting lever 79 by way of the hook lever 83. Accordingly, the connecting lever 79 is rotated in the counterclockwise direction as seen in FIG. 3 about the pivot 77 and moves the press roller 35 to an operative position where it is in contact with the side wall of the printing drum 30 as shown in FIG. 4. When the press roller 35 is thus moved to the operative position, the printing paper 9 conveyed to between the printing drum 30 and the press roller 35 can be conveyed pinched by the drum 30 and the press roller 35 for printing.

When the printing drum 30 and the rotary shaft 30*a* are further rotated by 180° in the clockwise direction, the press roller 35 is returned to the inoperative position away from the printing drum 30 shown in FIGS. 2 and 3. Thus the press roller 35 is repeatedly moved back and forth between the operative position and the inoperative position in synchronization with rotation of the printing drum 30.

Figure 5:
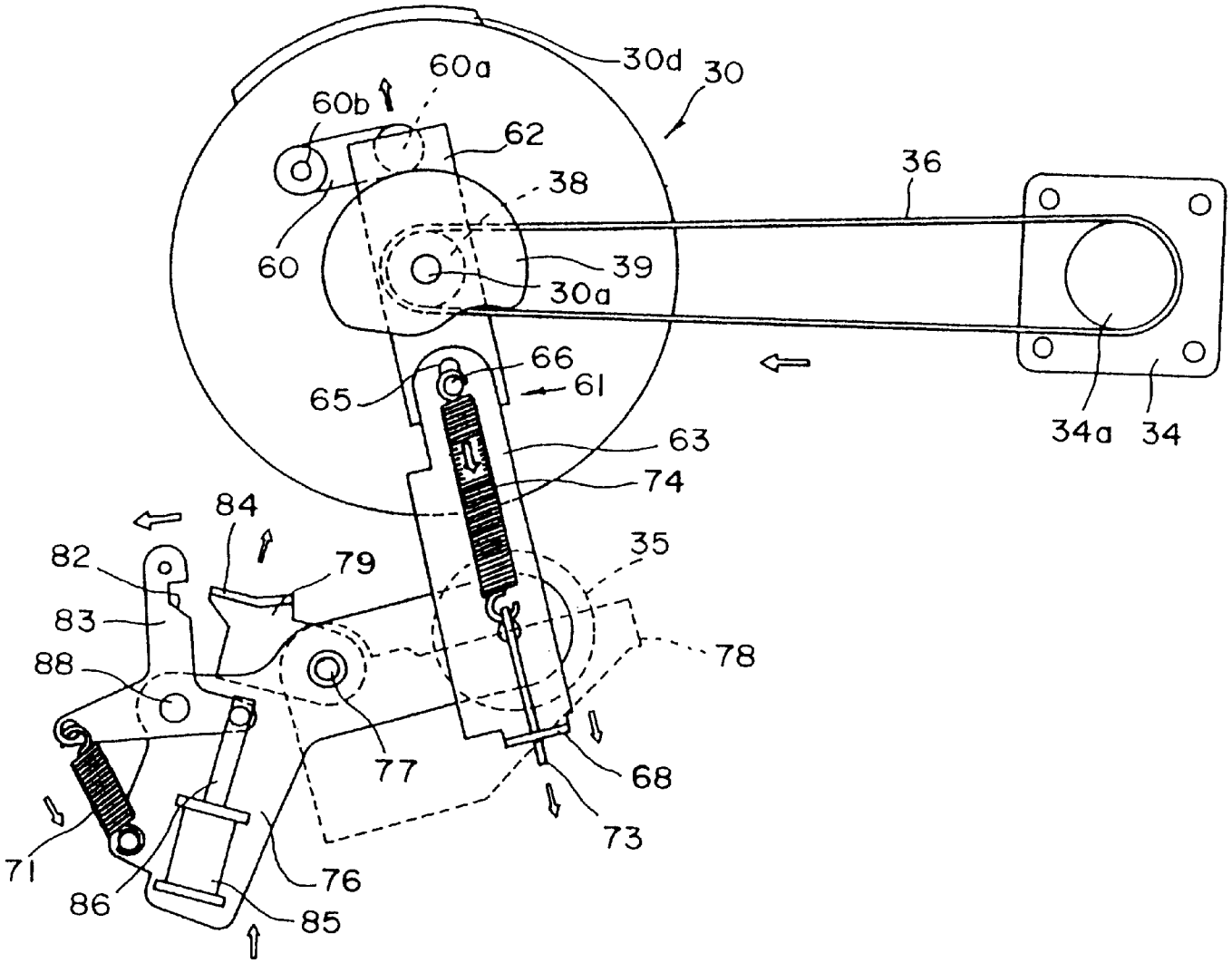
FIG. 5 is a schematic side view showing the press roller in the inoperative position with the eccentric press cam in a position different from that shown in FIG. 3.

On the other hand, when the press solenoid 85 is kept off while the elevated portion of the cam surface of the eccentric press cam 39 is holding upward the link member 61, the key groove 82 of the hook lever 83 is kept disengaged from the engagement portion 84 of the connecting lever 79 and accordingly rotation of the rotatable lever 76 is not transmitted to the connecting lever 79, whereby the press roller 35 is held in the inoperative position away from the printing drum 30 as shown in FIG. 5.

As shown in FIG. 1, the primary paper supply section 4 comprises a paper supply table 40, and a combination of a scraper 42, a pickup roller 43 and a paper supply clutch 44 which feeds out one printing paper 9 from the stack of the printing papers 9 on the paper supply table 40 for each rotation of the printing drum 30 and conveys the printing paper 9 to the secondary paper supply section 5.

Figure 7:
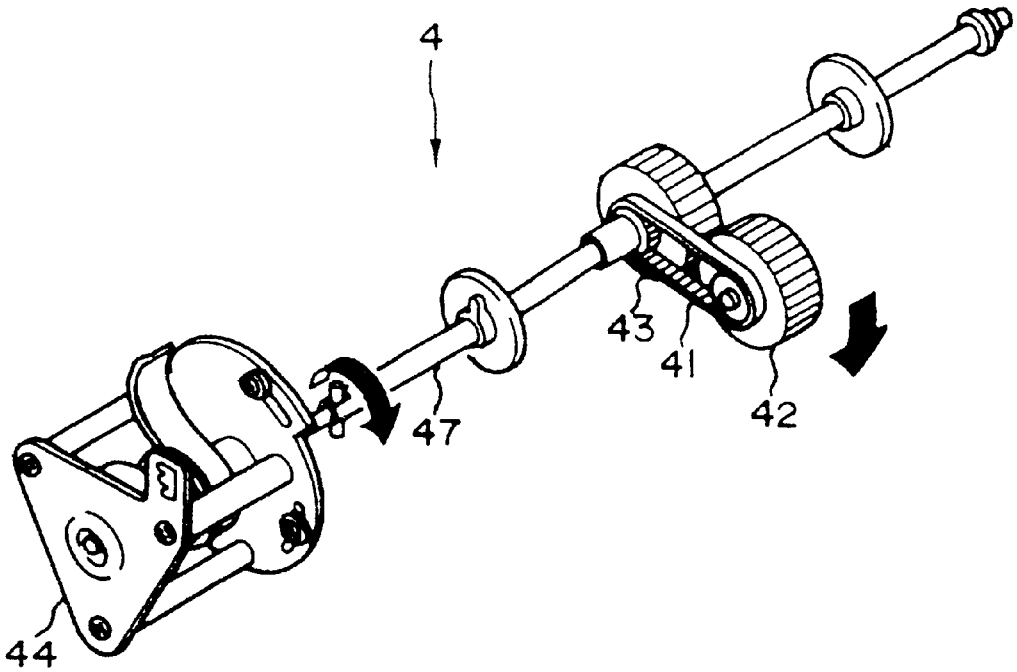
FIG. 7 is a perspective view showing in detail the mechanism of the primary paper supply section of the stencil printer.
Figure 8:
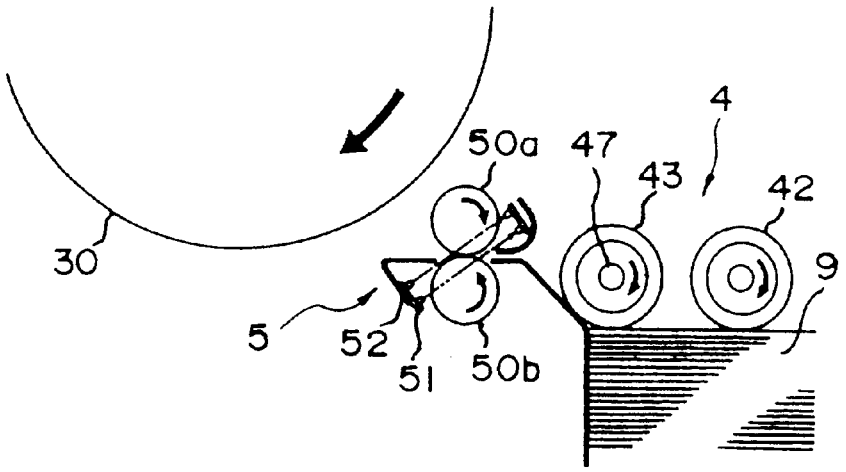
FIG. 8 is a fragmentary side cross-sectional view showing the primary paper supply section, the secondary paper supply section and the printing section of the stencil printer.

As shown in FIGS. 7 and 8, the pickup roller 43 is formed of a friction material and is fixed to a pickup shaft 47. The scraper 42 is connected to the pickup roller 43 by way of an endless belt 41 so that the scraper roller 42 is rotated together with the pickup roller 43.

The paper supply clutch 44 is connected to one end of the pickup shaft 47 to engage and disengage to transmit and not transmit rotation to the pickup shaft 47. In this particular embodiment, the paper supply clutch 44 is an electromagnetic clutch. The paper supply clutch 44 is engaged when the angular position of the printing drum 30 as detected by the drum position detecting means 37 becomes a predetermined position (30° in this particular embodiment).

Figure 9:
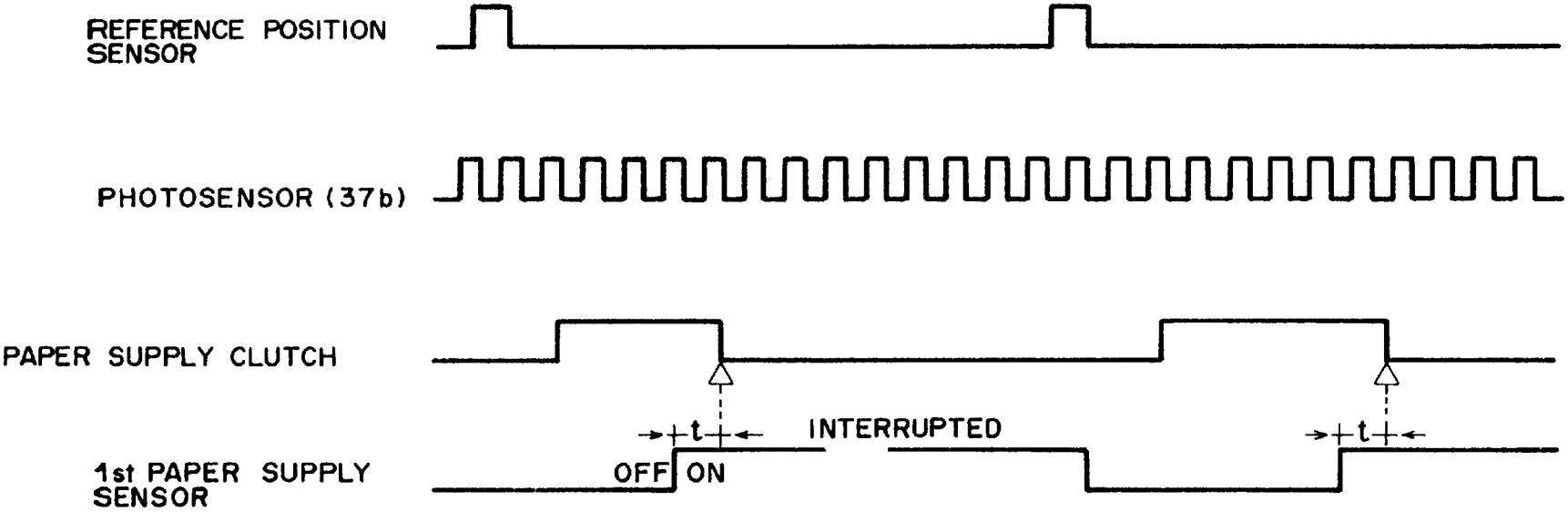
FIG. 9 is a timing chart showing the action of the paper supply clutch during printing.

FIG. 9 is a timing chart showing the action of the paper supply clutch 44 while printing is effected.

When printing is initiated and the main motor 34 is turned on, the printing drum 30 begins to rotate, and when the printing drum 30 rotates by 30°, the paper supply clutch 44 is engaged and the pickup roller 43 and the scraper 42 are turned in the direction indicated by arrows in FIGS. 7 and 8.

When a light beam for a first paper supply sensor (paper-in sensor) 51 of the second paper supply section 5 is interrupted while the printing paper 9 is conveyed, the paper supply clutch 44 is turned off after a predetermined time t and the pickup roller 43 and the scraper 42 are stopped, whereby primary paper supply is ended. At this time, the leading end of the printing paper 9 is stopped in contact with the guide roller 50*a* and/0*r* the timing roller 50*b*.

Thus, in the primary paper supply section 4, the paper supply clutch 44 is turned on and off in synchronization with rotation of the printing drum 30, whereby rotation of the pickup roller 43 and the scraper 42 is controlled so that one printing paper 9 is taken out from the stack of the printing papers on the paper supply table 40 for each rotation of the printing drum 30 and conveyed to the secondary paper supply section 5.

Each of the scraper 42 and the pickup roller 43 is provided with a one-way clutch and the paper supply clutch 44 is disengaged after the printing paper 9 is delivered to the secondary paper supply section 5 so that the scraper 42 and the pickup roller 43 rotate free drawn by the printing paper 9 after the printing paper 9 is delivered to the secondary paper supply section 5, thereby reducing back tension.

Figure 10A:
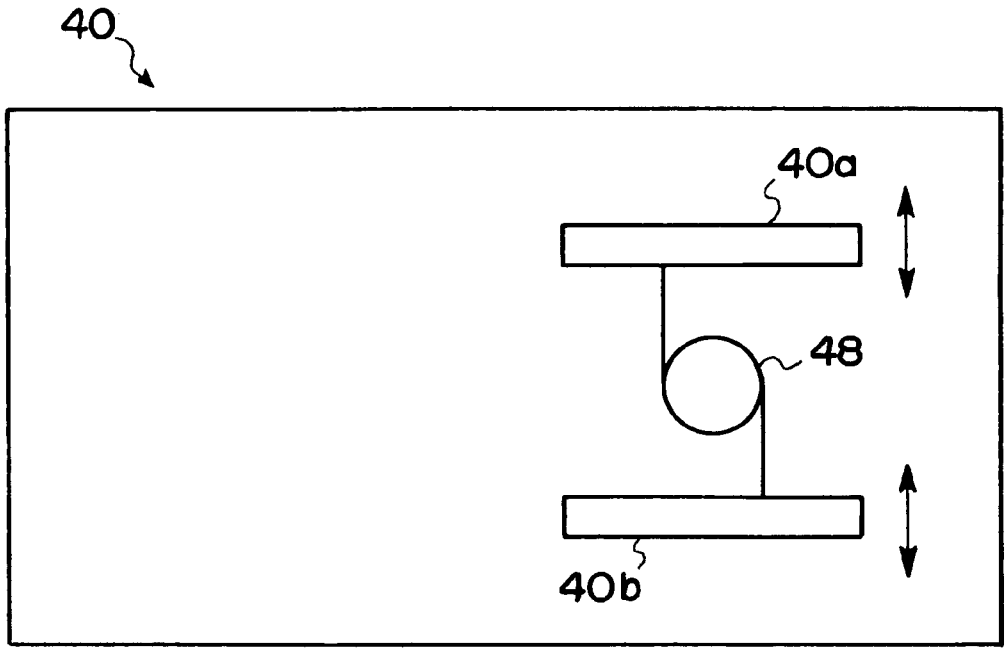
FIG. 10A and 10B present plan views of the paper supply table of the stencil printer.
Figure 10B:
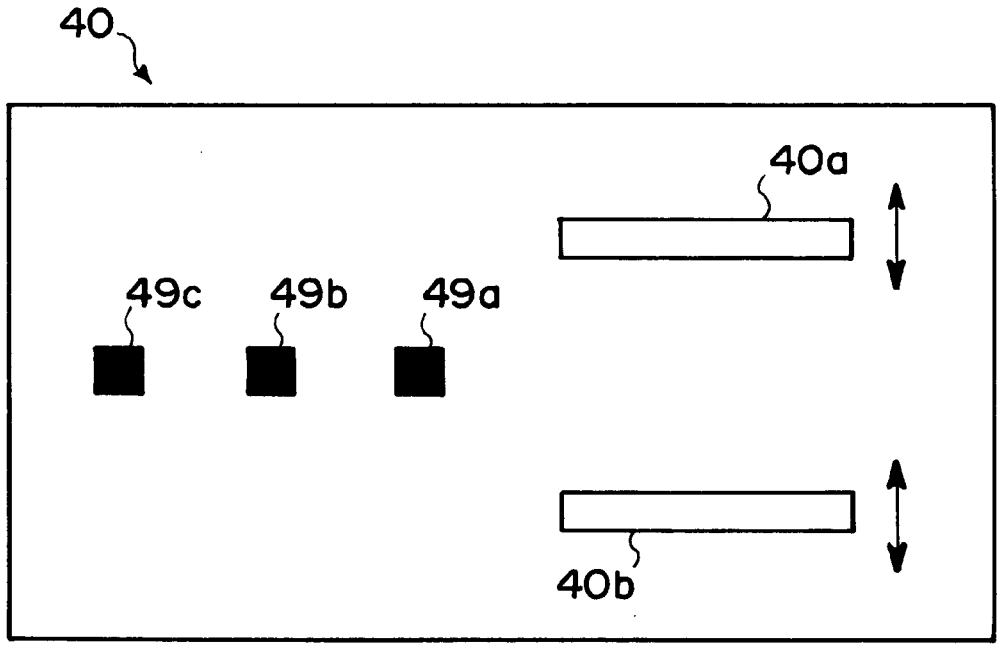

As shown in FIG. 10, the paper supply table 40 is provided with left and right fences 40*a* and 40*b* for centering the stack of the printing papers 9 irrespective of the size of the printing papers 9. The left and right fences 40*a* and 40*b* are movable toward and away from each other in synchronization with each other and a paper size detecting means 48, which may comprise, for instance, a potentiometer, detects the size of the printing papers 9 set to the paper supply table 40 on the basis of the position of the fences 40*a* and 40*b*. In place of such a paper size detecting means 48, a plurality of paper length sensors 49*a*, 49*b* and 49*c* as illustrated in FIG. 10B. The sensors 49*a* to 49*c* respectively detect the lengths of B4 size papers, A3 size papers and overlong (not shorter than 50 mm in this particular embodiment) papers.

As shown in FIG. 1, the secondary paper supply section 5 comprises the timing roller pair 50 (the guide roller 50*a* and the timing roller 50*b*) which inserts the printing paper 9 fed by the primary paper supply section 4 into between the printing drum 30 and the press roller 35, and the first and second paper supply sensors 51 and 52.

Figure 11:
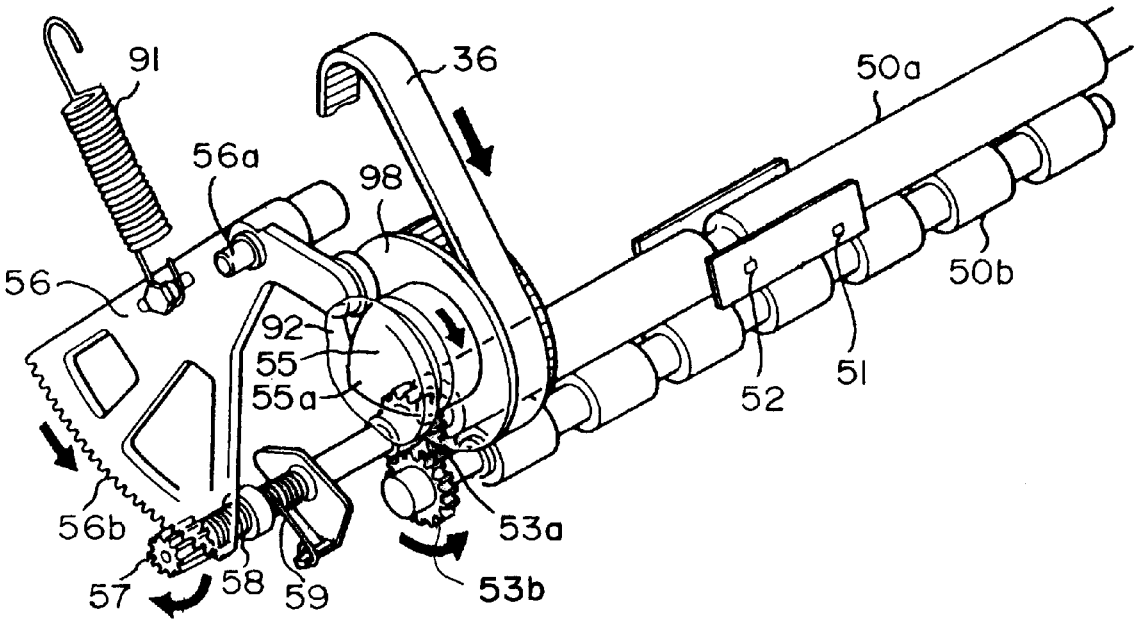
FIG. 11 is a fragmentary perspective view showing in detail the mechanism of the secondary paper supply section of the stencil printer.
Figure 12:
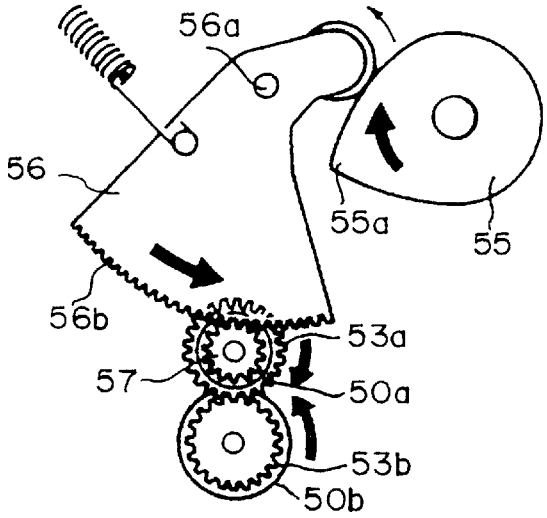
FIG. 12 is a side view of the secondary paper supply section.

As shown in detail in FIGS. 11 and 12, the guide roller 50*a* and the timing roller 50*b* are provided with gears 53*a* and 53*b* at each end of the shafts thereof.

The secondary paper supply section 5 is provided with a sprocket 98 and the sprocket 98 is drivingly connected to the drive gear 34*b* of the main motor 34 by way of an endless belt 36. A guide roller cam 55 having an elevated cam surface 55*a* is mounted on the outer side of the sprocket 98 to rotate integrally with the sprocket 98. A sector gear 56 is supported for rotation on the frame of the stencil printer by a pivot 56*a* and is urged in the clockwise direction in FIG. 11 by a spring 91. The sector gear 56 is provided with a cam follower portion in contact with the guide roller cam 55 and gear teeth 56*b* in mesh with a guide gear 57 which is provided on the shaft of the guide roller 50*a*. A one-way spring 58 and a load spring 59 are mounted on the shaft of the guide roller 50*a* near the guide gear 57.

Rotation of the main motor 34 is transmitted to the guide roller cam 55 by way of a transmission mechanism formed by the endless belt 36, the sprocket 98, the guide roller cam 55, the sector gear 56 and the guide gear 57, and the guide roller cam 55 is rotated. When the guide roller cam 55 is rotated, the elevated cam surface 55*a* of the guide roller cam 55 lifts the cam follower portion of the sector gear 56 overcoming the force of the spring 91 and the sector gear 56 is rotated in the direction of the arrow in FIGS. 11 and 12. Rotation of the sector gear 56 is transmitted to the guide roller 50*a* through mesh of the gear teeth 56*a* and the guide gear 57 and the guide roller 50*a* is rotated a predetermined number of times for each rotation of the printing drum 30.

Figure 13:
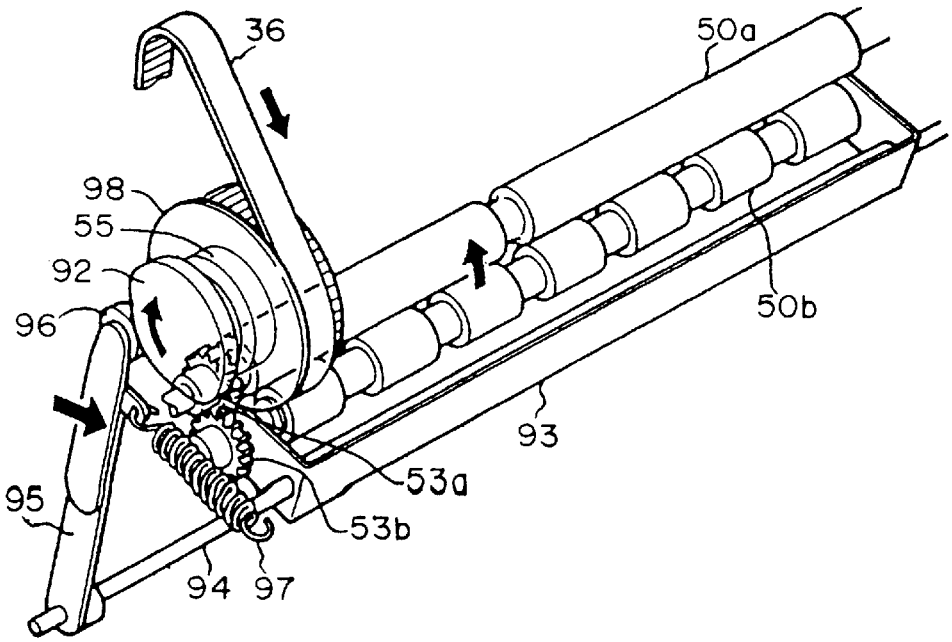
FIG. 13 is a fragmentary perspective view showing the mechanism for moving up and down the timing roller.
Figure 14:
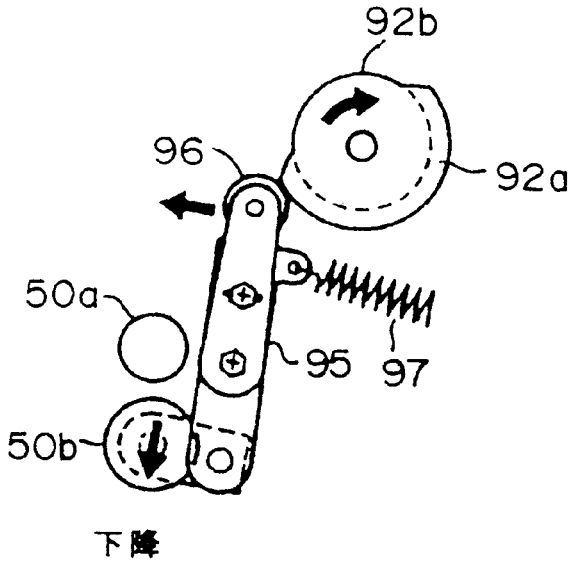
FIG. 14 is a schematic view showing the action of the mechanism when moving downward the timing roller.
Figure 15:
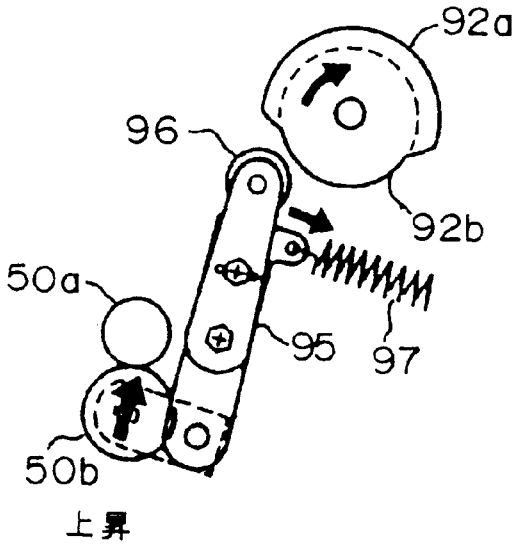
FIG. 15 is a schematic view showing the action of the mechanism when moving upward the timing roller.

As shown in FIGS. 13 to 15, a timing cam 92 which comprises a large diameter portion 92*a* and a small diameter portion 92*b* and is rotated integrally with the sprocket 98 is mounted on the outer side of the guide roller cam 55.

The large diameter portion 92*a* and the small diameter portion 92*b* of the timing cam 92 set the timing at which the timing roller 50*b* is stopped, and when the large diameter portion 92*a* is brought into contact with a cam follower 96, the guide roller 50*a* is stopped.

The timing roller 50*b* is supported for rotation on a channel-shaped frame 93 at each end portion thereof and a timing shaft 94 extends through the frame 93. A lower end of a timing lever 95 is connected to the timing shaft 94 and the upper end of the timing lever 95 is connected to the cam follower 96.

The gears 53*a* and 53*b* on opposite ends of the guide roller 50*a* and the timing roller 50*b* can be brought into mesh with each other and when the gears 53*a* and 53*b* are in mesh with each other, the timing roller 50*b* is rotated in the direction reverse to the guide roller 50*a* driven by the guide roller 50*b*.

The timing lever 95 is urged toward the timing cam 92 by a timing spring 97 so that the timing roller 50*b* is stopped as soon as the driving force to the guide roller 50*a* is cut without time lag due to inertia.

When the main motor 34 is turned on, the guide roller cam 55 is rotated in the direction of arrow in FIGS. 11 and 12 and the sector gear 56 is rotated in the direction of the arrow to rotate the guide roller 50*a*.

Further when the main motor 34 is turned on, the timing cam 92 is rotated in the direction of the arrow in FIGS. 13 to 15. While the large diameter portion 92*a* of the timing cam 92 is in contact with the cam follower 96, the timing roller 50*b* is held in the lower position shown in FIG. 14 where the gears 53*a* and 53*b* are disengaged from each other and rotation of the guide roller 50*a* is not transmitted to the timing roller 50*b*. When the small diameter portion 92*b* is brought into contact with the cam follower 96, the timing roller 50*b* is moved to the upper position shown in FIG. 15, where the timing roller 5O*b* abuts against the guide roller 50*a* with the gears 53*a* and 53*b* in mesh with each other and rotation of the guide roller 50*a* is transmitted to the timing roller 50*b*.

During the primary paper supply action, the timing roller 50*b* is moved to the upper position, where the timing roller 50*b* abuts against the guide roller 50*a* and the gears 53*a* and 53*b* are in mesh with each other.

When the printing paper 9 is conveyed from the primary paper supply section 4 to the secondary paper supply section 5 in this state, the leading end portion of the printing paper 9 abuts against the contact line between the guide roller 50*a* and the timing roller 50*b* and forms slack. The timing roller pair 50 is started at a predetermined angular position of the printing drum 30 and inserts the printing paper 9 into between the printing drum 30 and the press roller 35.

In response to the guide roller 50*a* being stopped, the large diameter portion 92*a* of the timing cam 92 is brought into contact with the cam follower 96 and the timing roller 50*b* is moved to the lower position shown in FIG. 14. Thus the timing roller 50*b* is moved away from the guide roller 50*a* at the time the guide roller 50*a* is stopped so that no back tension is applied to the printing paper 9 which is being conveyed by the printing drum 30 and the press roller 35.

By virtue of said one-way spring 58, rotation of the guide gear 57 in the reverse direction is not transmitted to the guide roller 50*a*. Further by virtue of the load spring 59, the guide roller 50*a* is immediately stopped after rotation of a predetermined amount so that the next printing paper 9 is not inverted.

As shown in FIG. 1, the paper discharge section 6 is provided downstream of the press roller 35 and comprises a scraper member 100 which separates the printing paper 9 from the printing drum 30 after printing, a paper discharge table 101 on which printing papers 9 separated from the printing drum 30 are stacked, a conveyor system 102 which conveys the printing papers 9 separated from the printing drum 30 to the paper discharge table 101 and a paper discharge sensor 103 which detects that the printing paper 9 separated from the printing drum 30 has been conveyed to the paper discharge table 101.

The printed printing paper 9 is separated from the printing drum 30 by the scraper member 100, conveyed to the paper discharge table 101 by the conveyor system 102 and is discharged on the paper discharge table 101 with its printed surface facing upward.

Figure 16:
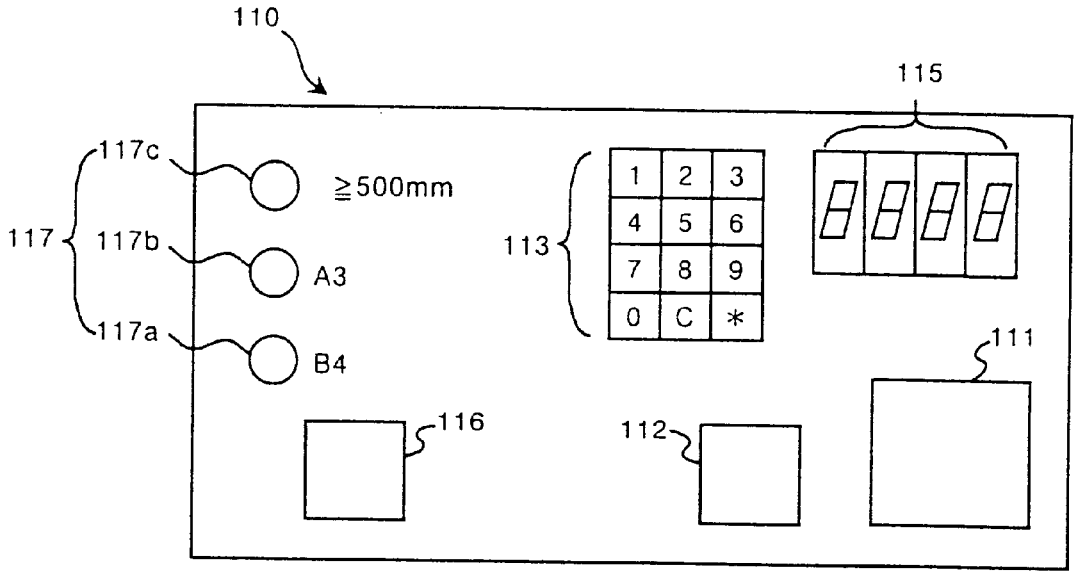
FIG. 16 is a plan view showing the control panel of the stencil printer.

The stencil printer is provided with a control panel 110 shown in FIG. 16. As shown in FIG. 16, the control panel 110 comprises a print start key 111, a print stop key 112, a tenkey pad 113 for inputting a print number, a print number display 115 which displays the remainder of the print number on the basis of the print number input through the tenkey pad 113 and print end signals which are output each time printing on one printing paper is ended, a paper size key 116 for selecting the size of printing paper 9, and a paper size display 117 which displays the selected paper size.

Figure 17:
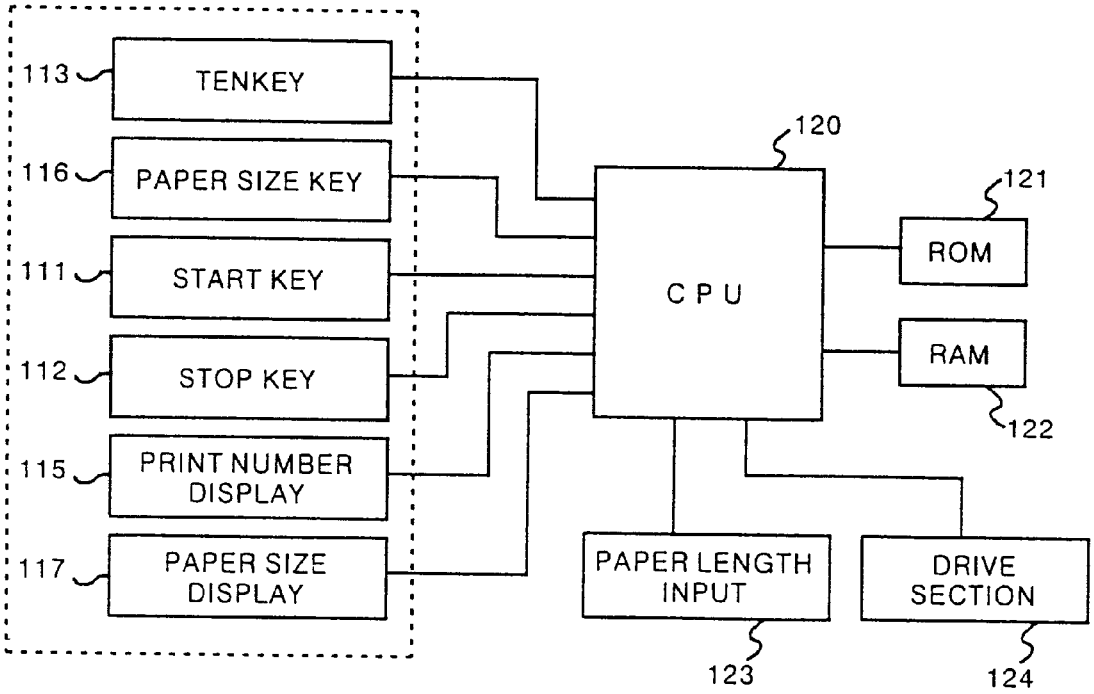
FIG. 17 is a block diagram showing the control section of the stencil printer.

As shown in FIG. 17, the print start key 111, the print stop key 112, the tenkey pad 113, the print number display 115, the paper size key 116, and the paper size display 117 are connected to a CPU 120. Further, a ROM 121, a RAM 122, a paper length input means 123, and a drive section 124 are connected to the CPU 120.

The CPU 120 controls paper supply so that a printing paper 9 under printing does not interfere with the next printing paper.

Program shown in flow charts to be described later is stored in the ROM 121 and data on the number of copies to be printed and the like are temporarily stored in the RAM 122.

The paper length input means 123 inputs information on whether the printing paper to be supplied is overlong into the CPU 120. Whether the printing paper to be supplied is overlong may be automatically detected while the printing paper 9 is conveyed or may be determined on the basis of a signal from a means for detecting the paper size in advance or for manually inputting the paper size.

The first paper supply sensor 51 automatically detects whether the printing paper to be supplied is overlong while the printing paper is conveyed. The paper size detecting means 48 or the paper length sensors 49*a*, 49*b* and 49*c* functions as the means for detecting the paper size in advance and the paper size key 116 on the control panel 110 functions as the means for manually inputting the paper size. These means are provided with an information input means (not shown) which informs the CPU 120 that the printing paper to be supplied is overlong. It is possible that a key for inputting that the printing paper to be supplied is overlong is provided on the control panel 110 and information that the printing paper to be supplied is overlong is directly input into the CPU 120 upon depression of the key.

The drive section 124 in FIG. 17 represents the stencil master making section 2, the printing section 3, the first and second paper supply section 4 and 5, and the paper discharge section 6, and more specifically the main motor 34, the paper supply clutch 44 and the like which drive these sections according to a flow chart to be described later under the control of the CPU 120.

Operation of the stencil printer of this embodiment will be described, hereinbelow.

First the stencil master 8 is made by the stencil master making section 2 and wound around the printing drum 30 in the known manner.

Then when the start key 111 on the control panel 110 is depressed, the printing drum 30 is started. When the printing drum 30 is rotated to a predetermined angular position (detected on the basis of the output of the encoder 37*a*), the paper supply clutch 44 is engaged and the scraper 42 and the pickup roller 43 are started, whereby one of the printing papers 9 on the paper supply table 40 is fed to the second paper supply section 5. Then when the first paper supply sensor 51 detects the printing paper 9, the paper supply clutch 44 is disengaged after a predetermined time t (FIG. 9). Thus the printing paper 9 is brought into abutment against the timing roller pair 50, i.e., the guide roller 50*a* and the timing roller 50*b* which are in contact with each other, whereby the printing paper 9 is stopped there with its leading end portion slackened. In response to disengagement of the paper supply clutch 44, the scraper 42 and the pickup roller 43 are stopped. When the printing drum 30 is rotated to another predetermined angular position, the guide roller 50*a* and the timing roller 50*b* are started and conveys the printing paper 9 toward the printing drum 30 and the press roller 35. When the printing paper 9 is detected by the second paper supply sensor 52 on the way to the printing drum 30, the press solenoid 85 is turned on and the press roller 35 is brought into contact with the side wall of the printing drum 30. When the leading end of the printing paper 9 is nipped by the printing drum 30 and the press roller 35, the timing roller 50*b* is moved away from the guide roller 50*a* and the printing paper 9 is released from the rollers 50*a* and 50*b*. The action of the timing roller 50*a* is controlled by the guide roller cam 55 and the timing roller cam 92 in the manner described above. When the printing paper 9 is subsequently detected by the paper discharge sensor 103, the paper discharge sensor 103 informs the print number display 115 on the control panel 110 that printing on one printing paper is ended. Then the print number display 115 reduces display of the number of copies to be printed by one. When the printing paper 9 is of a standard size, the next printing paper 9 has been fed to the secondary paper supply section 5 by this time.

Basically the stencil printer of this embodiment operates in the manner described above.

Control by the CPU 120 will be described, hereinbelow. For the purpose of simplicity of understanding, control by the CPU 120 will be first described with reference to the flow chart shown in FIGS. 18 to 21 assuming that the stencil printer is for only the printing papers of standard sizes.

Figure 28:
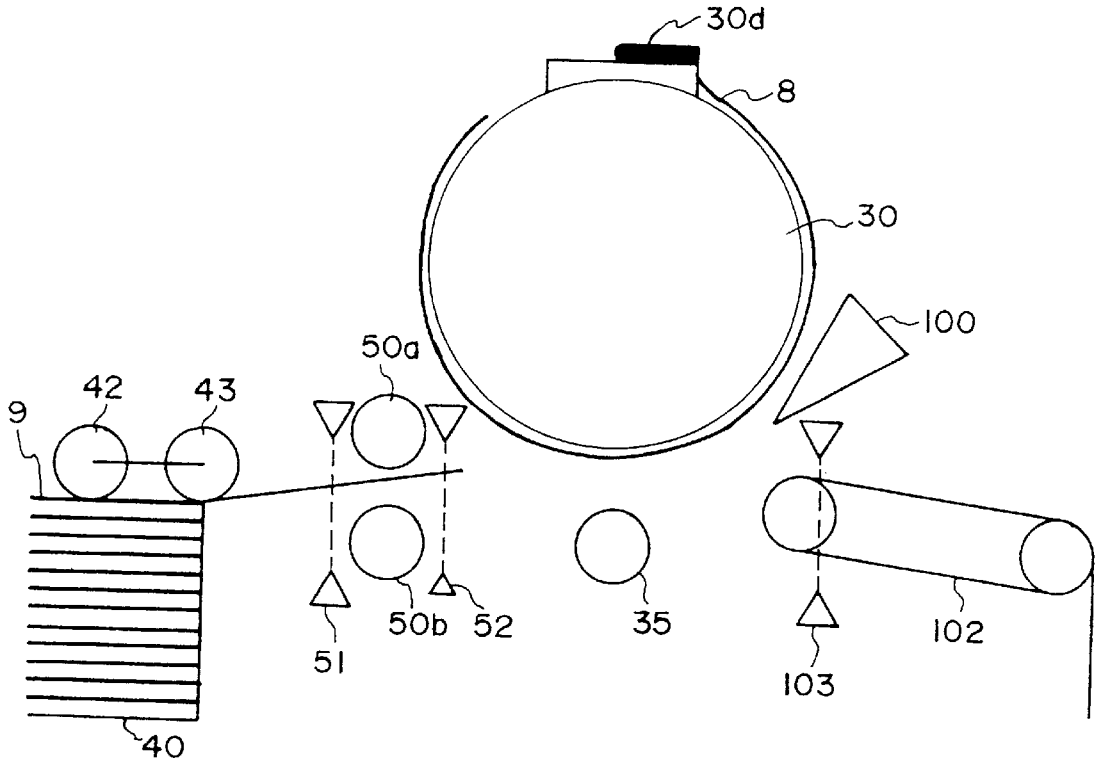

When the number of copies to be printed (print number) is input through the tenkey pad 113, the print number display 115 shows the number. (steps ST100 and 101) FIG. 28 shows the state of the sections 2 to 6 at this stage.

Then when the start key 111 is pressed, printing program is started and the main motor 34 is turned on. (steps ST102 in FIG. 18 and ST10 and ST11 in FIG. 19)

The CPU 120 defines the reference angular position of the printing drum 30, i.e., an angular position of 0°, referring to the output of the reference position sensor 37. (step ST12) The CPU 120 determines the current angular position of the printing drum 30 on the basis of the reference angular position and the output of the reference position sensor 37.

Figure 29:
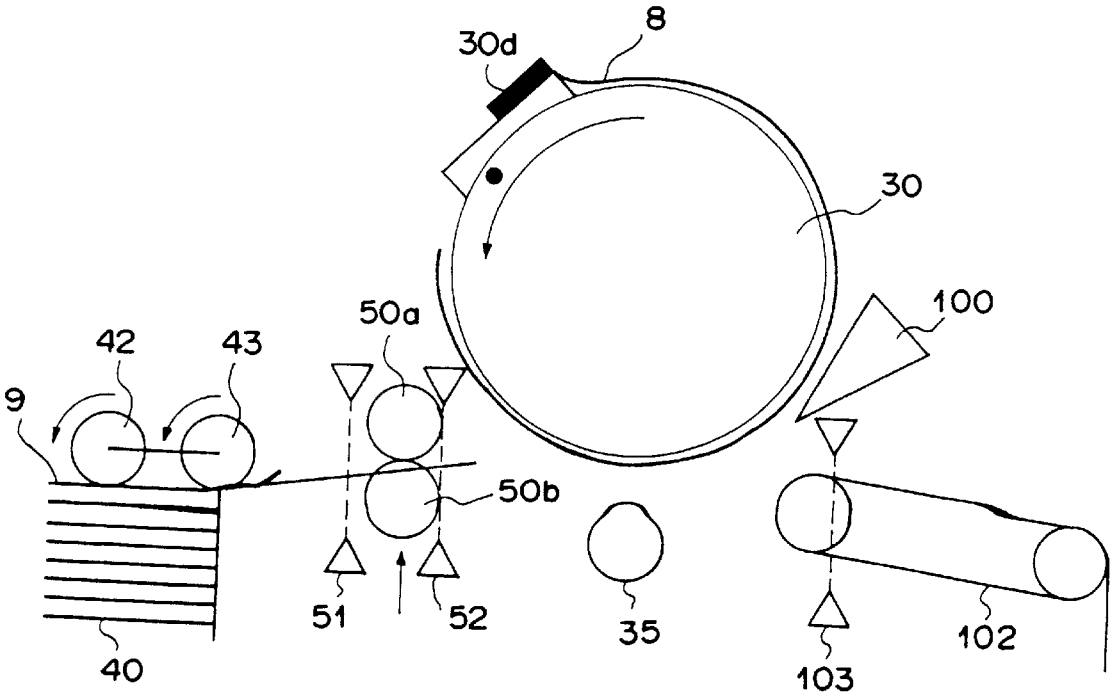

When the printing drum 30 is rotated by 30° from the reference angular position to a first predetermined position, the paper supply clutch 44 is engaged, and the pickup roller 43 and the scraper 42 start to rotate in the direction of the arrow in FIGS. 7 and 8, whereby one printing paper 9 is fed to the secondary paper supply section 5 from the paper supply table 40. (step ST14) During this primary paper supply action, the timing roller 50*b* is moved upward into contact with the guide roller 50*a*. FIG. 29 shows the state of the sections 2 to 6 at this stage.

Figure 30:
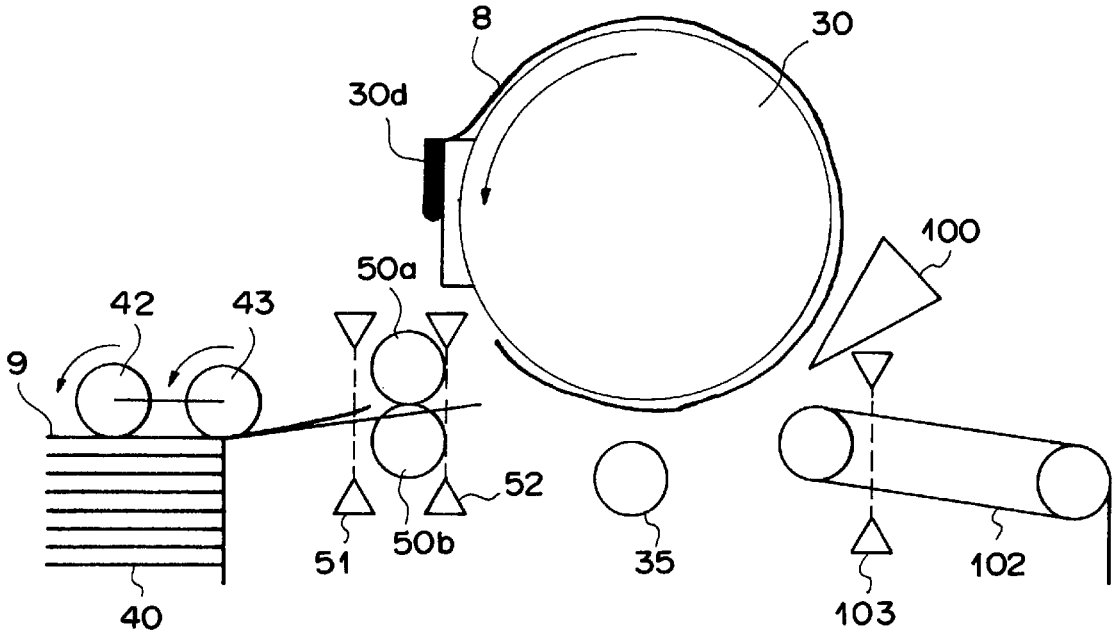

When the first paper supply sensor 51 of the secondary paper supply section 5 is turned on (i.e., the light beam for the first paper supply sensor 51 is interrupted) while the printing paper 9 is conveyed to the secondary paper supply section 5, the paper supply clutch 44 is disengaged after a predetermined time, whereby the pickup roller 43 and the scraper 42 are stopped and the primary paper supply is ended. (steps ST 15 and ST16) FIG. 30 shows the state of the sections 2 to 6 at this stage.

Figure 31:
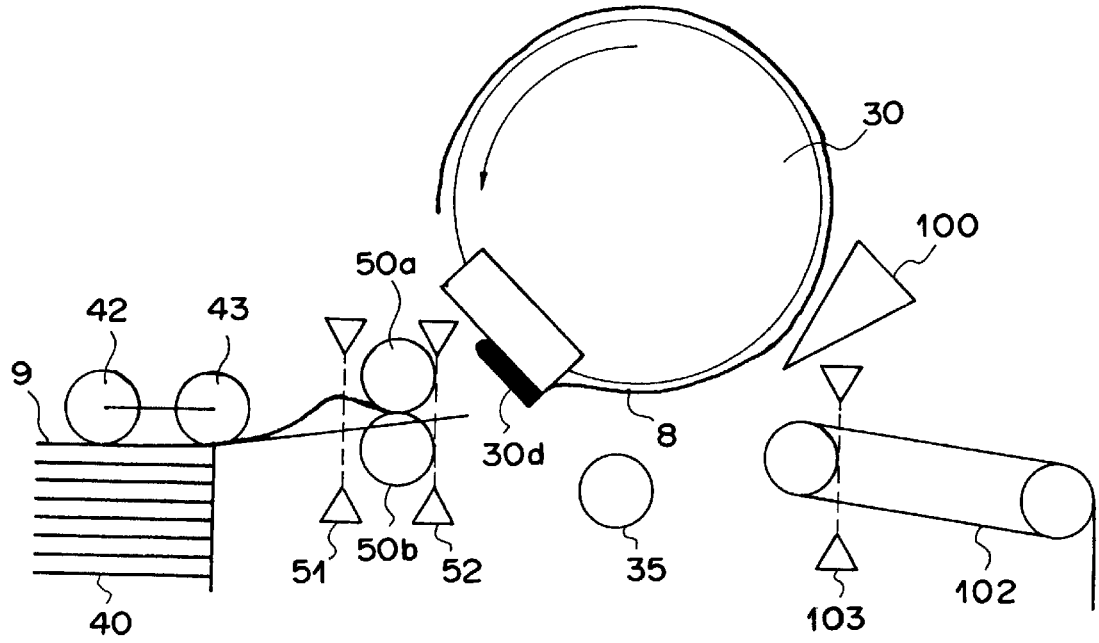

The leading end of the printing paper 9 conveyed from the primary paper supply section 4 abuts against the guide roller 50*a* and/or the timing roller 50*b* and the printing paper 9 is stopped. The leading end portion of the printing paper 9 is slackened at this time, which causes the printing paper 9 to be square with the rollers 50*a* and 50*b*, whereby the printing paper 9 is prevented from being obliquely conveyed during printing. FIG. 31 shows the state of the sections 2 to 6 at this stage.

Thereafter when the printing drum 30 is rotated to a second predetermined position, the elevated cam surface 55*a* of the guide roller cam 55 rotates the sector gear 56, thereby rotating the guide roller 50*a* and the timing roller 50*b*, and the printing paper 9 is conveyed toward the printing drum 30. (step ST 17)

Figure 32:
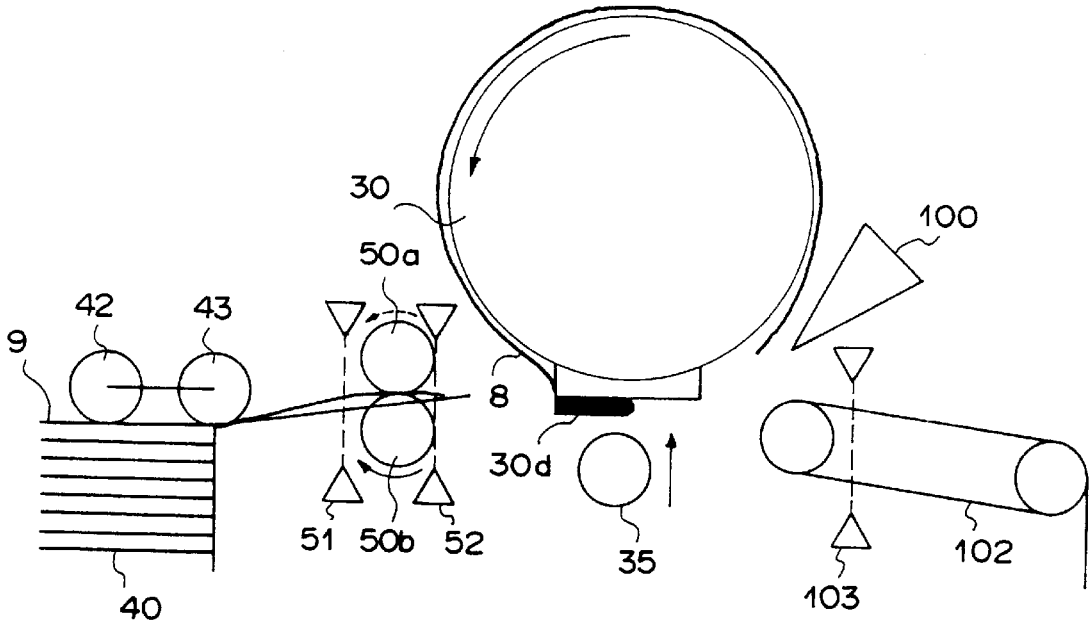

When the leading end of the printing paper 9 is detected by the second paper supply sensor 52, the press solenoid 85 is turned on. Since the link member 61 is held upward by the elevated portion of the cam surface of the eccentric press cam 39 at this time, the engagement portion 84 of the connecting lever 79 is brought into engagement with the key groove 82 of the hook lever 83 and the connecting lever 79 is rotated in the counterclockwise direction in FIG. 3, thereby lifting the press roller 35 into contact with the printing drum 30. (steps ST18 and ST19) FIG. 32 shows the state of the sections 2 to 6 at this stage.

Figure 33:
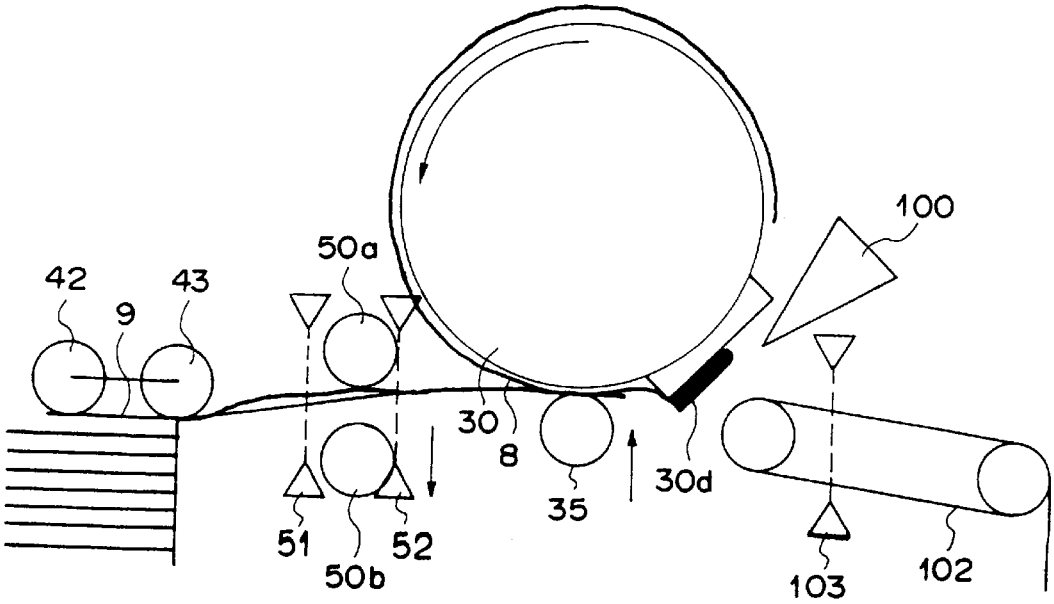

When the press roller 35 is moved upward and the leading end portion of the printing paper 9 is pinched between the printing drum 30 and the press roller 35, the guide roller 50*a* is stopped and the timing roller 50*b* is moved downward away from the guide roller 50*a*. (step ST20) FIG. 33 shows the state of the sections 2 to 6 at this stage.

Then the printing drum 30 is kept rotated and printing is effected while the printing paper 9 is conveyed pinched between the printing drum 30 and the press roller 35. (step ST21)

Figure 34:
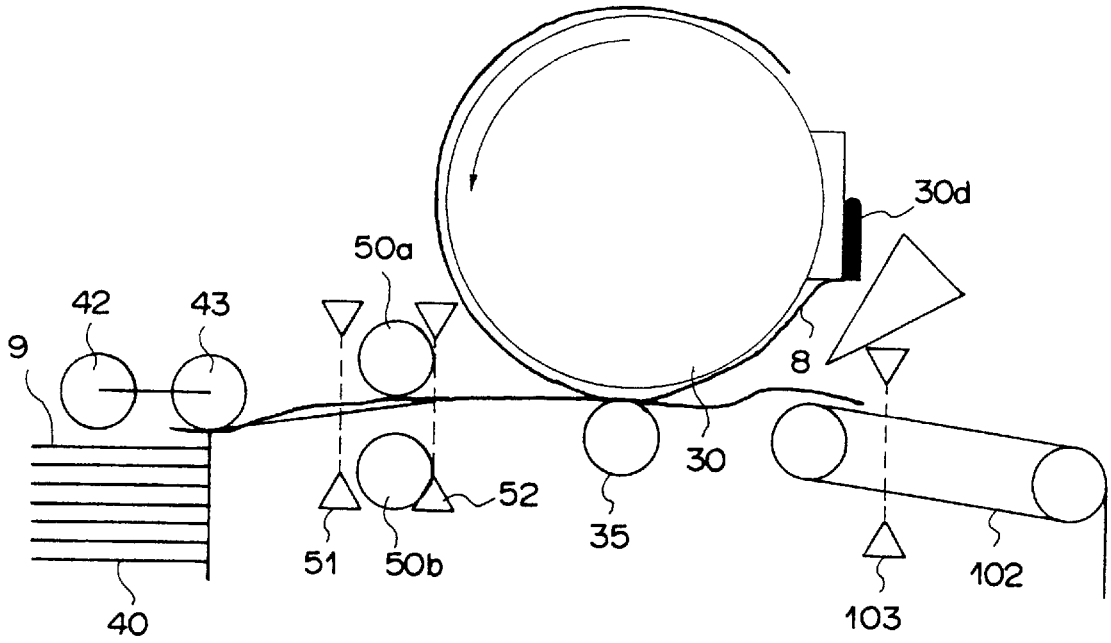
Figure 35:
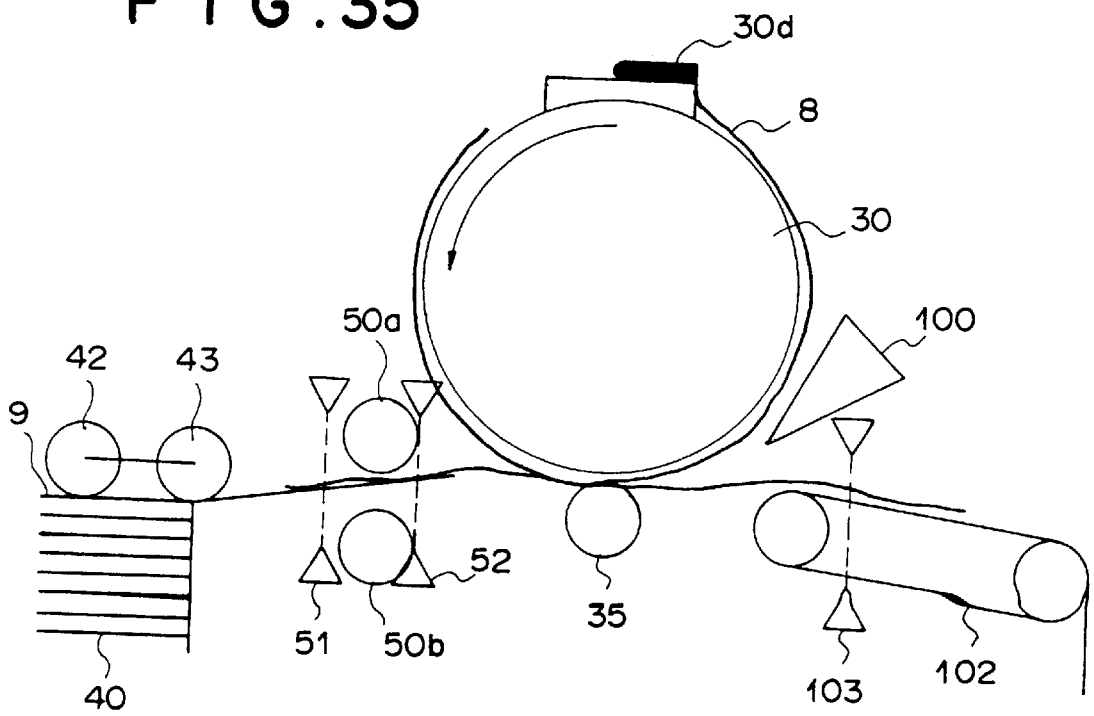

During the printing step, the leading end portion of the printing paper 9 is peeled off the printing drum 30 by the scraper member 100 and a scraper fan (not shown). FIG. 34 shows the state of the sections 2 to 6 at this stage. As the printing drum 30 is further rotated, the printed printing paper 9 is conveyed by the conveyor system 102 attracted against the conveyor belt under a suction force applied from a suction means (not shown) and is discharged onto the paper discharge table 101. FIG. 35 shows the state of the sections 2 to 6 at this stage.

When the paper discharge sensor 103 is turned on after the printing drum 30 passes the reference position (angular position of 0°) while the preceding printing paper 9 is conveyed to the paper discharge table 101, a paper supply signal is turned on. (steps ST30 and ST31) When the paper discharge sensor 103 is not turned on, that is, when the printing paper 9 is not normally discharged, predetermined error processing is effected. (step ST38A)

When the printing drum 30 is rotated to the first predetermined position (30°) after the paper discharge sensor 103 is turned on, the paper supply clutch 44 is engaged. (steps ST32 and ST33)

When the paper supply clutch 44 is engaged, the pickup roller 43 and the scraper 42 start to rotate in the direction of the arrow in FIGS. 7 and 8, whereby a next printing paper 9 is fed to the secondary paper supply section 5 from the paper supply table 40. (step ST33) During this primary paper supply action, the timing roller 50*b* is moved upward into contact with the guide roller 50*a*.

Figure 36:
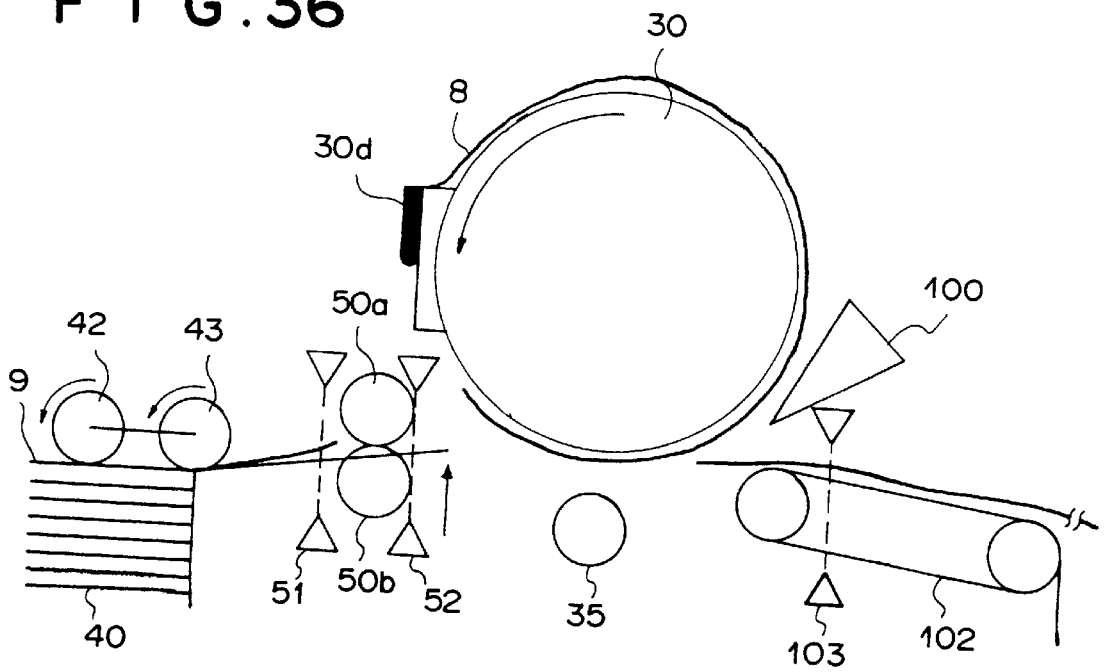

When the first paper supply sensor 51 of the secondary paper supply section 5 is turned on (i.e., the light beam for the first paper supply sensor 51 is interrupted) while the next printing paper 9 is conveyed to the secondary paper supply section 5, the paper supply clutch 44 is disengaged after a predetermined time t, whereby the pickup roller 43 and the scraper 42 are stopped and the primary paper supply is ended. (steps ST34 and ST35) At this time, the press sensor 90 is receiving the light beam, i.e., printing, on the first printing paper 9 has been ended, and the press solenoid 85 is off. Further the eccentric press cam 39 is in the position shown in FIGS. 2 and 3, and the link member 61 is held downward, where the press roller 35 is held away from the printing drum 30. FIG. 36 shows the state of the sections 2 to 6 at this stage.

Thereafter when the printing drum 30 is rotated to the second predetermined position, the elevated cam surface 55*a* of the guide roller cam 55 rotates the sector gear 56, thereby rotating the guide roller 50*a* and the timing roller 50*b*, and the printing paper 9 is conveyed toward the printing drum 30. (step ST36) When the paper discharge sensor 103 is not off at this time, the system is having some trouble, and accordingly predetermined error processing is effected. (steps ST37 and ST38B) On the other hand, when the paper discharge sensor 103 is off, the CPU 120 informs the print number display 115 that printing on one printing paper has been ended. (step ST39) Then the print number display 115 reduces display of the number of copies to be printed by one.

When the leading end of the next printing paper 9 is detected by the second paper supply sensor 52, the press solenoid 85 is turned on and the press roller 35 is moved upward into contact with the printing drum 30. (steps ST40 and ST41)

When the press roller 35 is moved upward and the leading end portion of the printing paper 9 is pinched between the printing drum 30 and the press roller 35, the guide roller 50*a* is stopped and the timing roller 50*b* is moved downward away from the guide roller 50*a*. (step ST42) The state of the sections 2 to 6 at this stage is the same as that shown FIG. 33.

Then the printing drum 30 is kept rotated and printing is effected while the printing paper 9 is conveyed pinched between the printing drum 30 and the press roller 35. (step ST43)

After the printing drum 30 passes the reference position (angular position of 0°) while the preceding printing paper 9 is conveyed to the paper discharge table 101, the CPU 120 returns to step ST31 and repeats steps ST31 to ST45 on another printing paper 9 unless a stop signal is input. (steps ST44 and ST45) When a stop signal is input, the press solenoid 85 is turned off and the press roller 35 is moved downward, the main motor 34 is turned off and the printing drum 30 30 is stopped when the printing drum 30 is rotated to the reference position, and printing is stopped. (steps ST46 to ST49) The stop signal is input when the stop key 112 on the control panel 110 is pressed, when there remains no printing paper 9 on the paper supply table 40 or an error signal is generated.

Now control which is to be executed by the CPU 120 when printing is to be effected on overlong printing papers 9 will be described, hereinbelow. A case where whether a printing paper 9 which is being conveyed is overlong is automatically detected and the CPU 120 controls the respective sections 2 to 6 so that paper jam does not occur will be first described with reference to the flow chart shown in FIGS. 22 and 23, hereinbelow.

Figure 18:
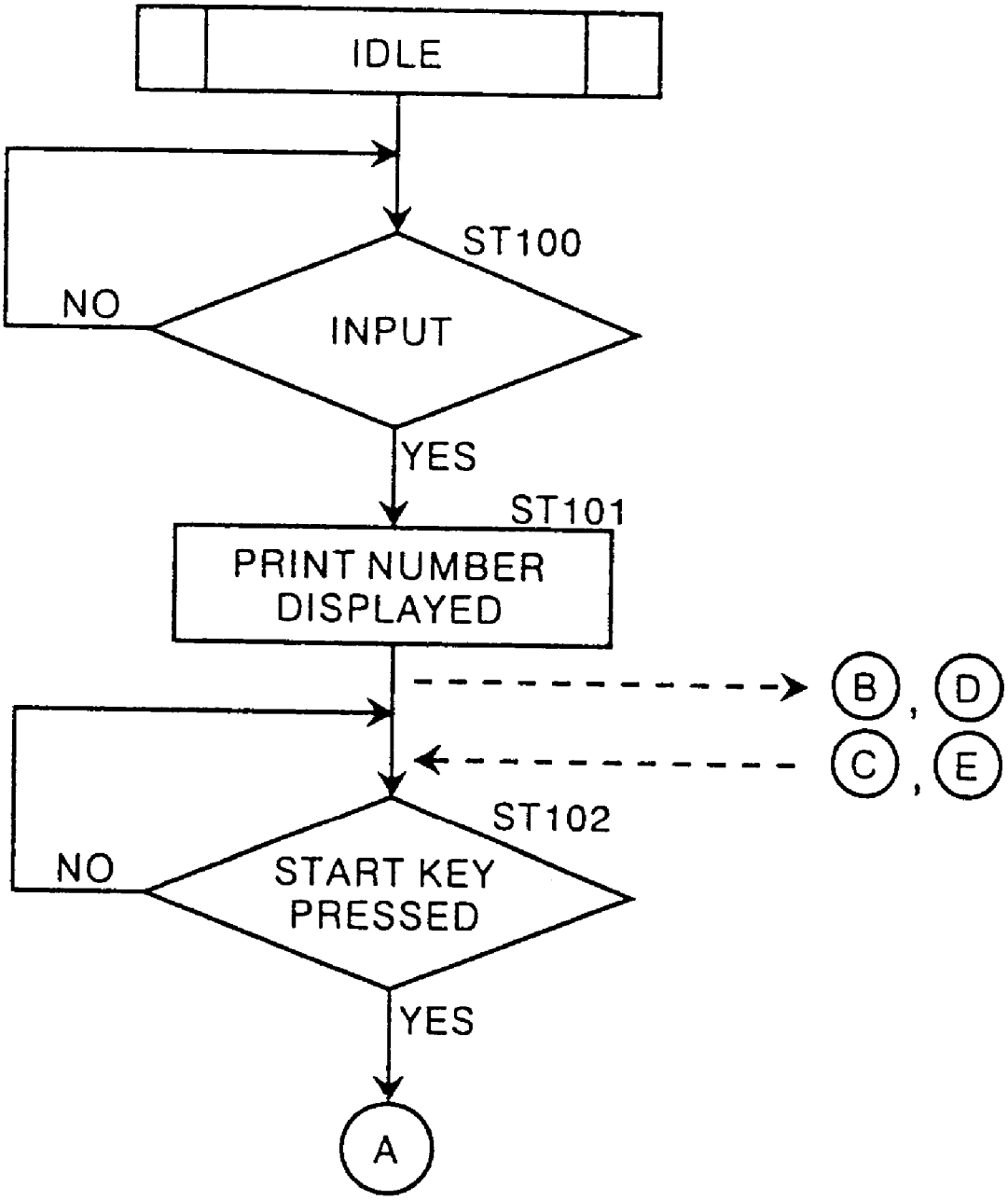
FIGS. 18 to 21 show a flow chart for illustrating the operation of the CPU when the stencil printer makes print only on standard size printing papers.
Figure 19:
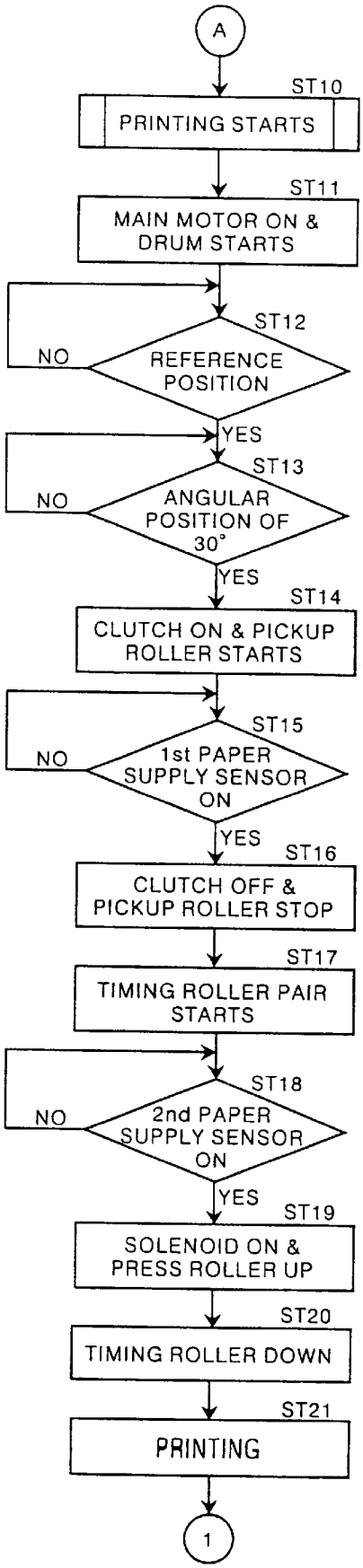
Figure 20:
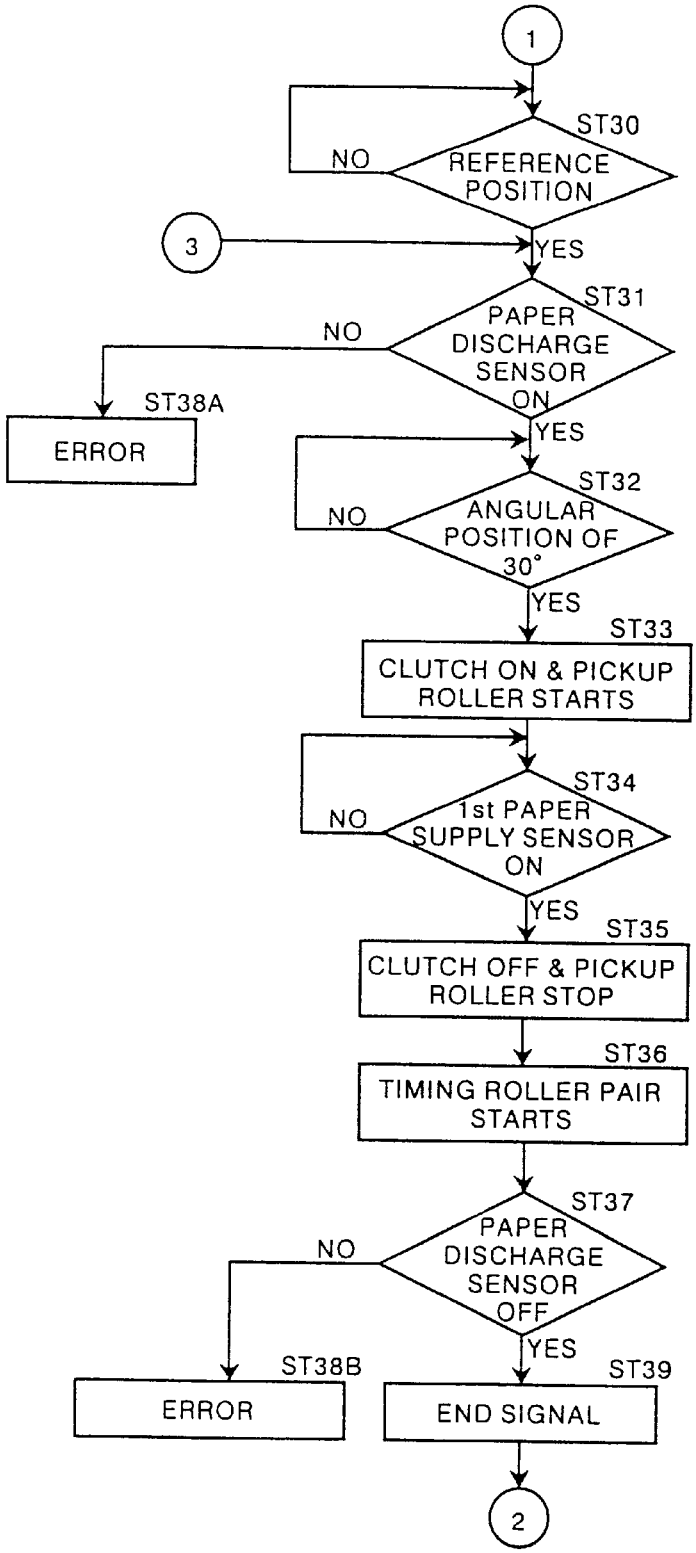
Figure 21:
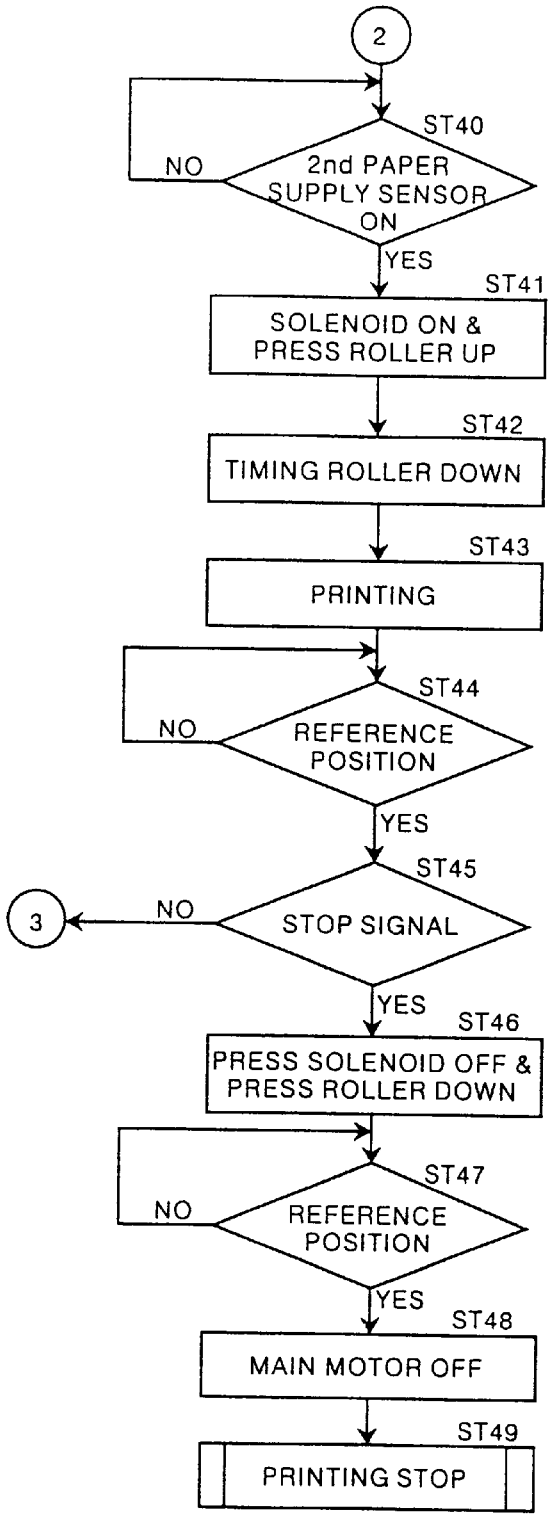
Figure 22:
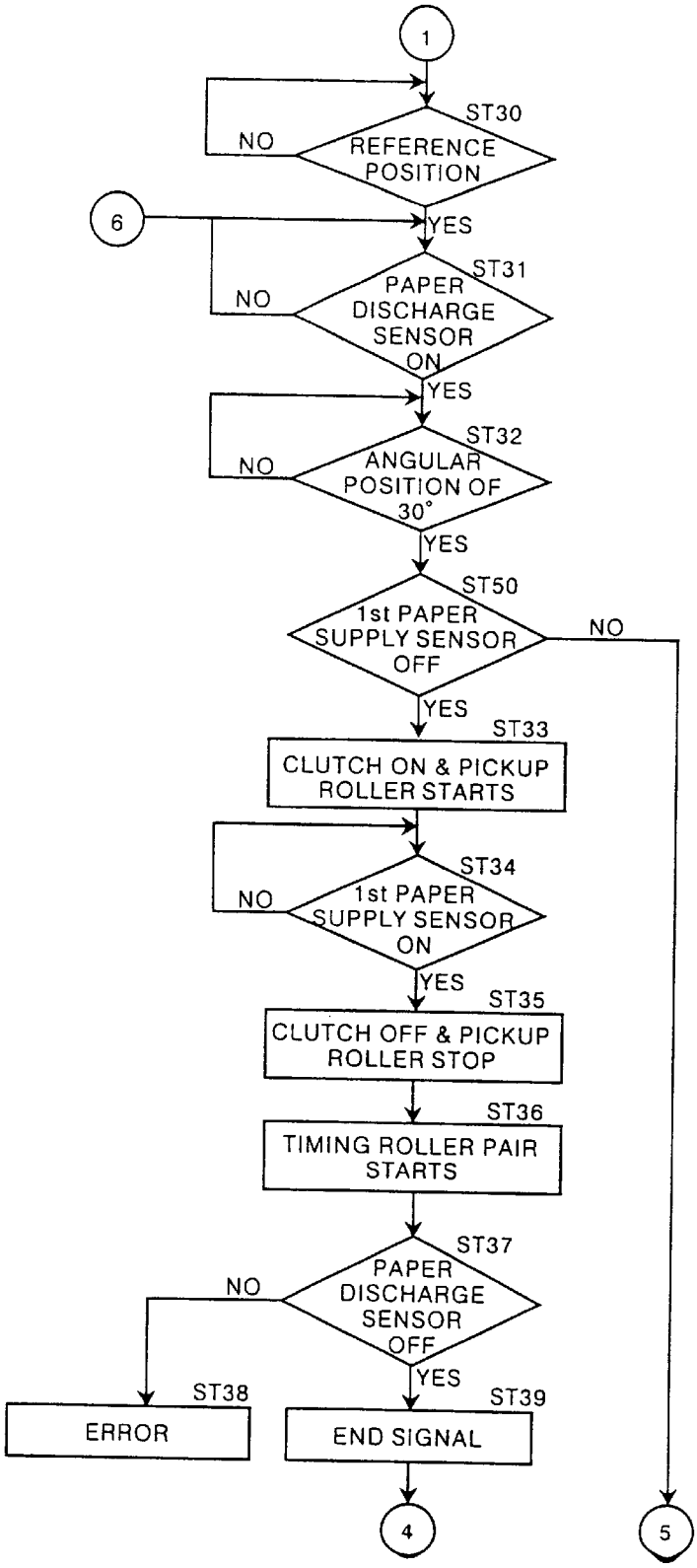
FIGS. 22 and 23 show a flow chart corresponding to the flow chart shown in FIGS. 20 and 21 which the CPU executes when whether the printing paper is overlong is to be automatically detected while it is conveyed.
Figure 23:
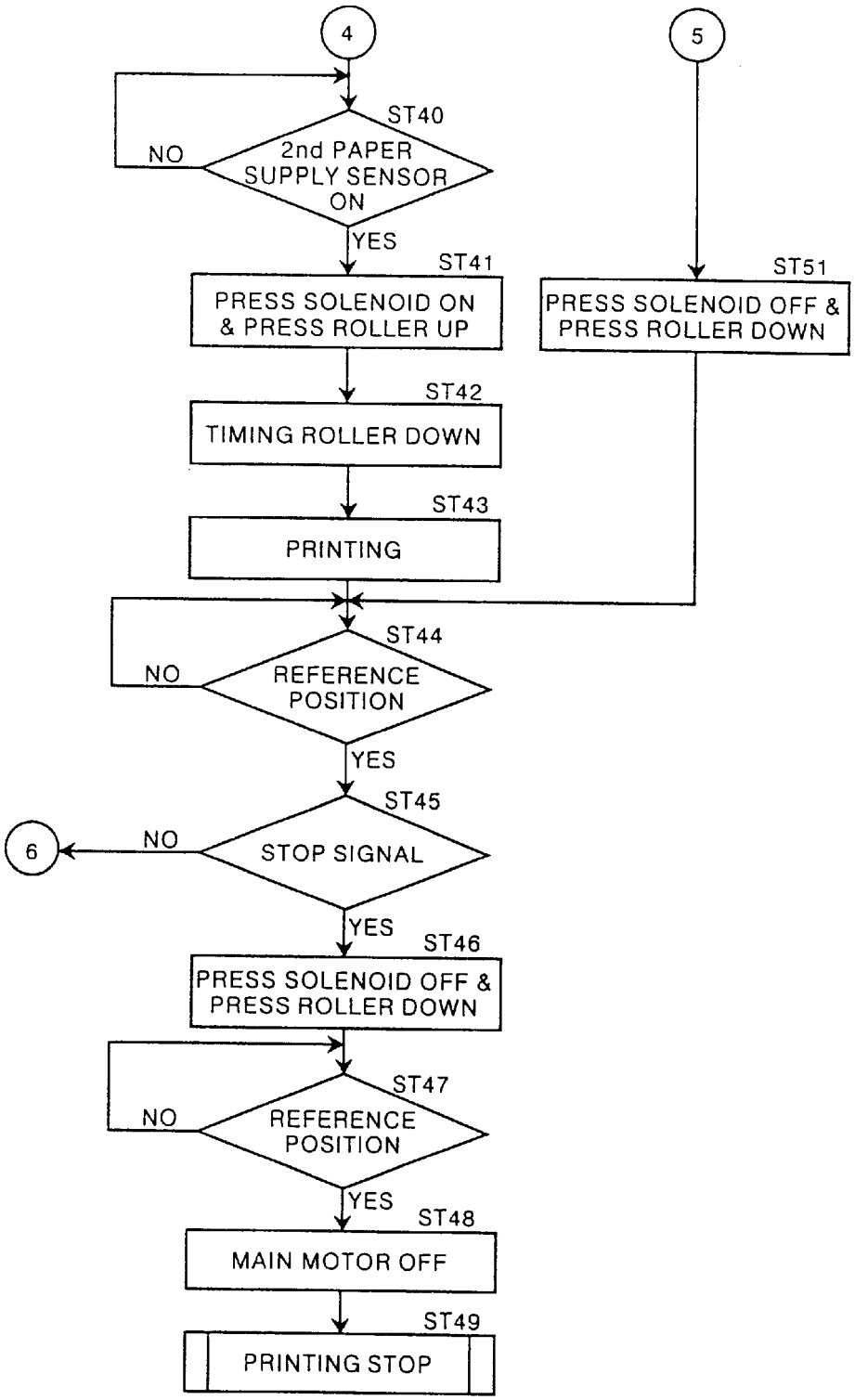

The control by the CPU 120 in this case differs from that shown in FIGS. 18 to 21 in that a step of determining whether the first paper supply sensor 51 is off (step ST50 in FIG. 22) is inserted between steps ST32 and ST33 (FIG. 20) and step ST51 (FIG. 23) is added. In FIGS. 22 and 23, steps analogous to those shown in FIGS. 20 and 21 are given the same step numbers and will not be described here.

Figure 37:
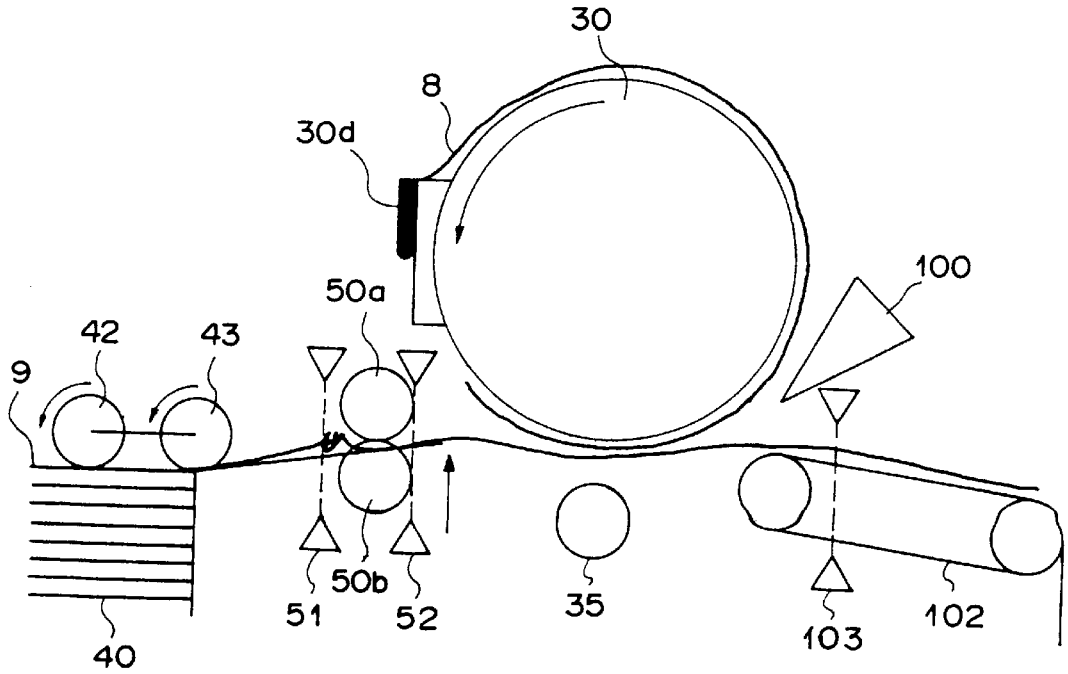

When overlong printing papers are fed and printing thereon is effected under the control of the CPU 120 according to the flow chart shown in FIGS. 19 to 21, the leading end portion of the next printing paper conveyed from the primary paper supply section 4 to the secondary paper supply section 5 can collide against the trailing end portion of the preceding printing paper which is still in the secondary paper supply section 5 and cause paper jam as shown in FIG. 37.

The steps shown in FIGS. 22 and 23 are to be executed after step ST21 in FIG. 19 and differ from the steps shown in FIGS. 20 and 21 in steps ST50 and ST51 as described above. Steps ST50 and ST51 will be described in detail, hereinbelow.

When the printing drum 30 is rotated to the first predetermined position (angular position of 30°) after printing on the preceding printing paper 9 is ended, the CPU 120 determines whether the first paper supply sensor 51 is off. (step ST50) When the first paper supply sensor 51 is off, which shows that the preceding printing paper 9 is of a standard size, the CPU 120 executes step ST33 and the following steps which are the same as those shown in FIGS. 20 and 21.

On the other hand, when the first paper supply sensor 51 is on, which shows that the preceding printing paper 9 is overlong, information input means informs the CPU 120 that the preceding printing paper is overlong and upon receipt of the information, the CPU 120 executes step ST51 without engaging the paper supply clutch 44. When the paper supply clutch 44 is kept disengaged, the pickup roller 43 and the scraper 42 are kept stopped and accordingly the next printing paper 9 is not fed.

Irrespective of whether the first paper supply sensor 51 is off, the printing drum 30 is kept rotating and accordingly the secondary paper supply section 5 and the printing section 3 are actuated in response to the guide roller cam 55 or the eccentric press cam 39 though no printing paper is supplied to the printing drum 30 and the press roller 35.

When the printing drum 30 is rotated to the position where the eccentric press cam 39 lifts upward the link member 61, the press solenoid 85 is turned off irrespective of the output of the second paper supply sensor 52. (step ST51) When the press solenoid 85 is turned off, the press roller 35 is held downward away from the printing drum 30. That is, when the primary paper supply is not effected, the press roller 35 is kept away from the printing drum 30 and accordingly the press roller 35 and/or the printing paper 9 thereon are not stained with ink.

After step ST51, the CPU 120 executes step ST44 and the following steps. At this time, the trailing end portion of the preceding printing paper 9 is completely discharged from the secondary paper supply section 5 by the time at which step ST50 is to be executed and accordingly the primary paper supply is effected and printing is effected on the next printing paper according to the steps up to step ST43.

Thus in this embodiment, when the printing paper 9 is of such a length that the trailing end portion of the printing paper 9 cannot be completely discharged from the secondary paper supply section 5 in one rotation of the printing drum 30, the primary paper supply of the next printing paper 9 is inhibited, and another rotation of the printing drum 30 is used only for discharging the preceding printing paper 9, and the primary paper supply of the next printing paper 9 is resumed in response to a third rotation of the printing drum 30 when the preceding printing paper 9 has been completely discharged. Accordingly printing on overlong printing papers can be normally effected without paper jam and the like.

When the printing paper 9 is of such a length that the printing paper 9 cannot be completely discharged from the secondary paper supply section 5 in two rotations of the printing drum 30, step ST51 is repeated until the first paper supply sensor 51 is turned off.

Further, though, in the description above, the primary paper supply of the next printing paper 9 is inhibited while the preceding printing paper 9 is being conveyed through the secondary paper supply section 5, i.e., through the timing roller pair 50, the present invention need not be limited to such an arrangement provided that the paper supply of the next printing paper 9 is controlled so that the next printing paper does not collide with the preceding printing paper. For example, the paper supply of the next printing paper may be inhibited while the preceding printing paper 9 is being conveyed between the printing drum 30 and the press roller 35.

Whether the preceding printing paper 9 is being conveyed between the printing drum 30 and the press roller 35 can be detected, for instance, by a paper detecting means which detects existence of the printing paper 9 near the contact line between the printing drum 30 and the press roller 35 at a predetermined time.

A case where the length of the printing papers 9 is detected in advance or input by the user and the CPU 120 controls the respective sections 2 to 6 so that paper jam does not occur when the printing papers 9 are overlong will be described with reference to the flow charts shown in FIGS. 24 to 27, hereinbelow.

The control by the CPU 120 in this case basically the same as that shown in FIGS. 18 to 21 except that the primary paper supply of the next printing paper is inhibited when the printing papers 9 are overlong, which is informed to the CPU 120 from a means for detecting the paper size in advance or a means for manually inputting the paper size. In FIGS. 24 to 27, steps analogous to those shown in FIGS. 18 to 21 are given the same step numbers and will not be described in detail here.

Figure 24:
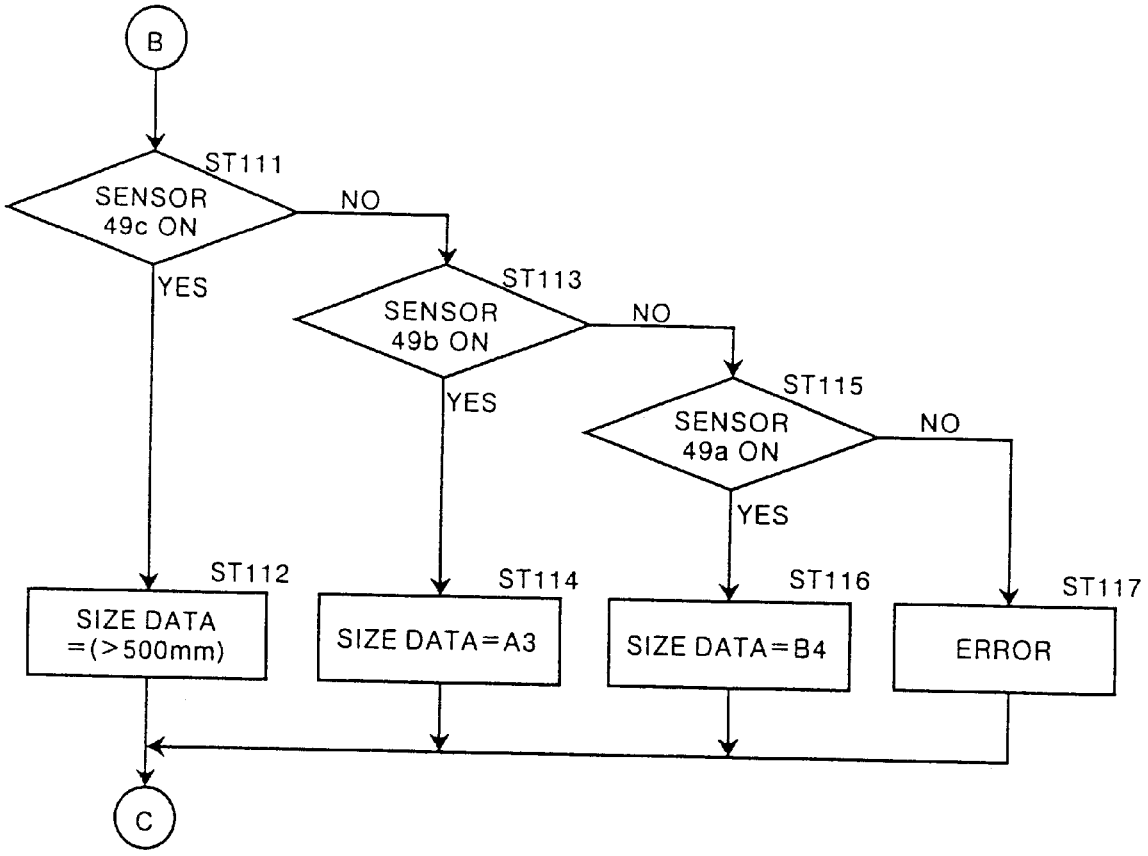
FIG. 24 is a flow chart for illustrating the operation of the CPU when the paper size is to be detected in advance.
Figure 26:
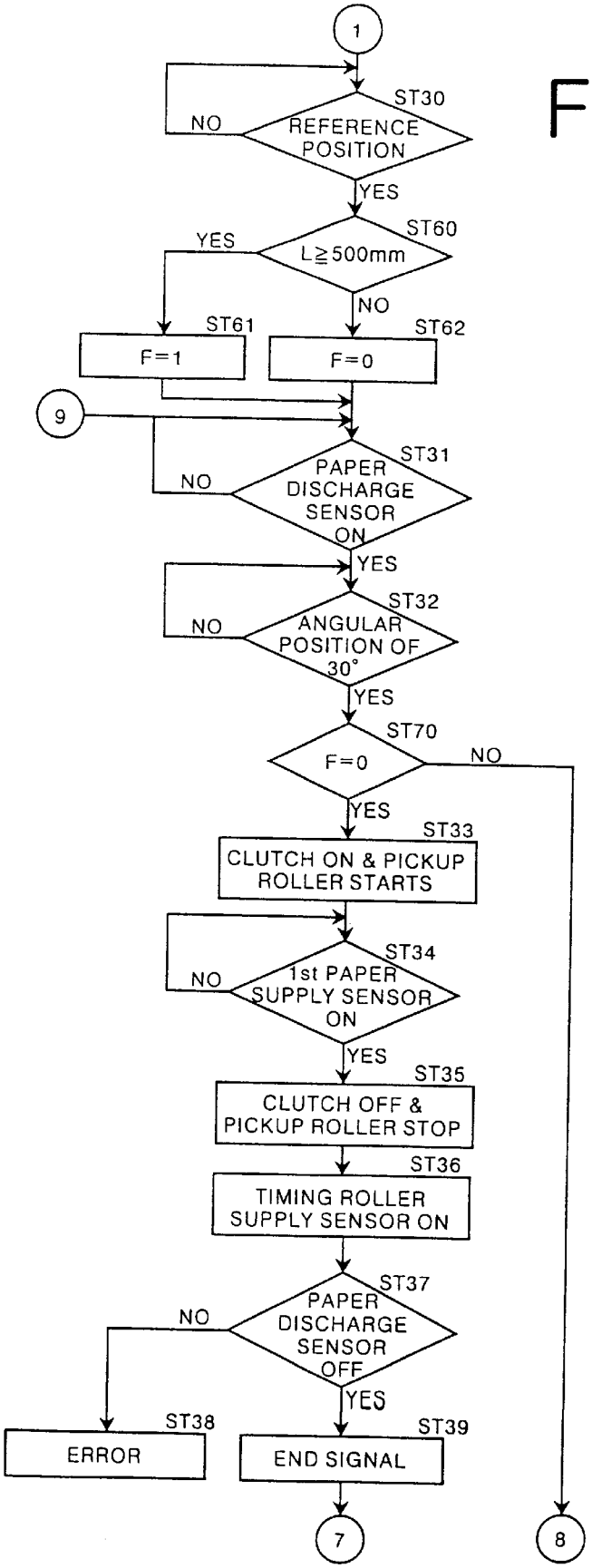
FIGS. 26 and 27 show a flow chart corresponding to the flow chart shown in FIGS. 20 and 21 which the CPU executes when whether the printing paper is overlong is detected by the processing shown in FIG. 24 or 25, and FIGS. 28 to 37 are schematic views showing the states of the stencil printer at different stages.
Figure 27:
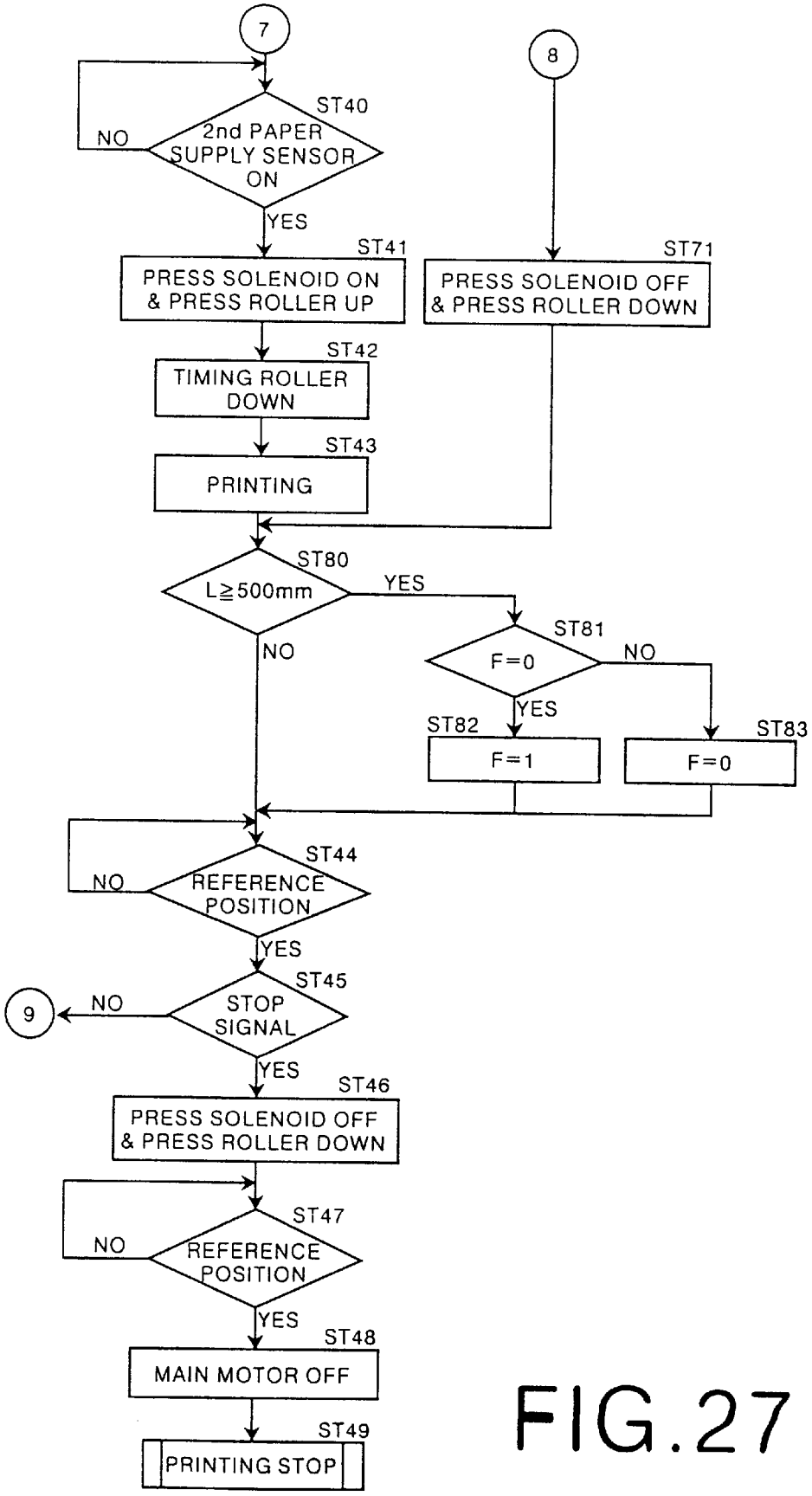

The steps shown in FIGS. 26 and 27 are to be executed after step ST21 in FIG. 19. When the paper size is detected in advance, the steps shown in FIG. 18 to be executed before printing is started (step ST10 in FIG. 19) is modified as follows. That is, steps ST111 to ST117 shown in FIG. 24 are executed before step ST102 as shown by the dotted arrow in FIG. 18. When the output of the paper length sensor 49*c* is on, that is, the paper length sensor 49*c* is detecting a printing paper, paper size data is set to be "not shorter than 500 mm". (steps ST111 and ST112) When the output of the paper length sensor 49*c* is off and the output of the paper length sensor 49*b* is on, paper size data is set to be "A3". (steps ST113 and ST114) When the output of the paper length sensor 49*b* is off and the output of the paper length sensor 49*a* is on, paper size data is set to be "B4". (steps ST115 and ST116) When the output of the paper length sensor 49*a* is off, there is not printing paper placed on the paper supply table 40. Accordingly an error signal is input into the CPU 120.

When the paper size is input by the user, the steps shown in FIG. 18 to be executed before printing is started (step ST10 in FIG. 19) is modified as follows. That is, steps ST121 to ST126 shown in FIG. 25 are executed before step ST102 as shown by the dotted arrow in FIG. 18.

When the paper size key 116 on the control panel 110 is once pressed, a LED 117*a* is turned on to show that the paper size is B4 and paper size data is set to be "B4". (steps ST121 and ST122) When the paper size key 116 on the control panel 110 is pressed again, the LED 117*a* is turned off and a LED 117*b* is turned on to show that the paper size is A3 and paper size data is set to be "A3". (steps ST123 and ST124) When the paper size key 116 on the control panel 110 is pressed one more time, the LED 117*b* is turned off and a LED 117*c* is turned on to show that the paper size is not smaller than 500 mm and paper size data is set to be "not shorter than 500 mm". (steps ST125 and ST126)

When the paper size key 116 is not pressed again within a predetermined time, the CPU 120 executes step ST102 holding the paper size data at that time. When the paper size key 116 is not pressed within a predetermined time in step ST121, a predetermined one of the LEDs 117*a* to 117*c* is turned on and the paper size data is set to be that corresponding to the LED.

Figure 25:
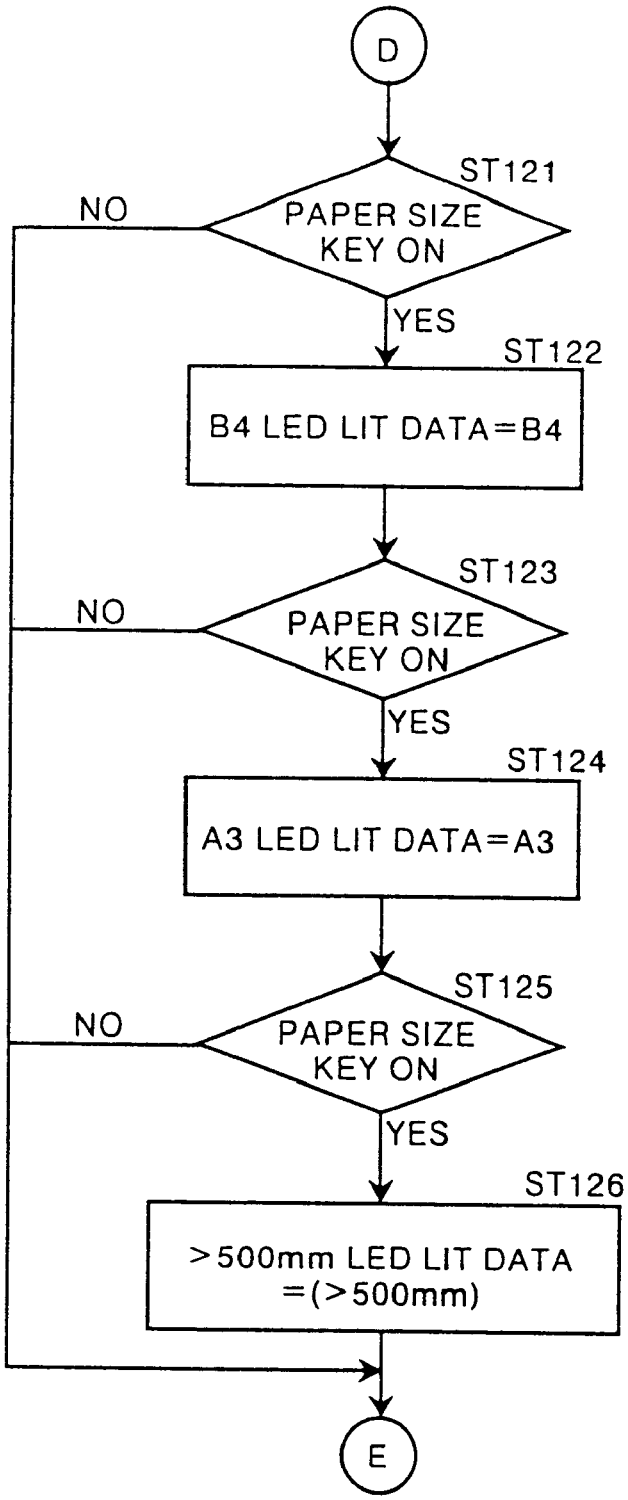
FIG. 25 is flow chart for illustrating the operation of the CPU when the paper size is to be input by the user.

Irrespective of whether the paper size data is set in accordance with the processing shown in FIG. 24 or FIG. 25, an information input means (not shown) informs the CPU 120 that the printing papers 9 are overlong when the paper size data is set to be "not shorter than 500 mm" and otherwise informs the CPU 120 that the printing papers 9 are not overlong.

After the paper size data is set in accordance with the processing shown in FIG. 24 or FIG. 25, the steps shown in FIG. 19 are executed and the steps shown in FIGS. 26 and 27 are executed after the steps shown in FIG. 19.

The steps shown in FIGS. 26 and 27 will be described hereinbelow.

After the printing drum 30 passes the reference position (angular position of 0°) while the preceding printing paper 9 is conveyed to the paper discharge table 101, the CPU 120 determines whether the preceding printing paper 9 is overlong, i.e., whether the length L of the preceding printing paper 9 as measured in direction of conveyance is not shorter than 500 mm. (steps ST30 and ST60) The CPU 120 sets an overlong flag F to "1" when it is determined that the preceding printing paper 9 is overlong, and otherwise to "0". Then when the paper discharge sensor 103 is on, a paper supply signal is turned on. (step ST31)

When the printing drum 30 is rotated to the first predetermined position (30°) after the paper discharge sensor 103 is turned on, it is determined whether the overlong flag F is 0. (steps ST32 and ST70) When it is determined that the overlong flag F is 0, that is, the preceding printing paper 9 is shorter than 500 mm, the CPU 120 thereafter executes steps ST33 to ST43 which are the same as those described above with reference to FIGS. 20 and 21 and will not be described here. On the other hand, when it is determined that the overlong flag F is 1, the CPU 120 executes step ST71 without executing the primary paper supply in step ST33. Step ST71 is the same as step ST51 shown in FIG. 23 and will not be described here.

After step ST43 or ST71, the CPU 120 executes step ST80. In step ST80, it is determined whether the preceding printing paper 9 is overlong. When it is determined that the preceding printing paper 9 is not overlong, the CPU 120 immediately executes step ST44 and the following steps. On the other hand, when it is determined that the preceding printing paper 9 is overlong, the CPU 120 executes step ST44 and the following steps after steps ST81 to ST83. That is, when it is determined that the preceding printing paper 9 is overlong, it is further determined in step ST81 whether the overlong flag F is 0. When the overlong flag F is 0, the overlong flag F is changed to 1 and when the overlong flag F is 1, the overlong flag F is changed to 0. (steps ST82 and ST83)

With this arrangement, processing in which the first paper supply and printing are effected (processing including steps ST33 to ST43) and processing in which the first paper supply and printing are not effected (processing including steps ST71 in place of steps ST33 to ST43) are alternately executed.

Thus also in this control by the CPU 120, the primary paper supply can be stopped for one rotation of the printing drum 30 after printing on an overlong printing paper is effected. Accordingly printing on overlong printing papers can be normally effected without paper jam and the like.

Though, in the control described above, the primary paper supply is stopped for one rotation of the printing drum 30 after printing on an overlong printing paper is effected, the primary paper supply can be stopped for two or more rotations of the printing drum 30 after printing by executing step ST83, where the overlong flag F is changed to 0, once per two or more rotations of the printing drum 30, whereby printing on very long printing papers (e.g., printing paper whose length is twice or more of the standard length) can be normally effected without paper jam and the like.

Though description has been made in the case where the primary paper supply is inhibited so long as the preceding printing paper is still in the secondary paper supply section 5, the present invention need not be limited to such a form provided that the paper supply of the next printing paper is controlled so that the next printing paper does not collide with the preceding printing paper. For example, instead of inhibiting the primary paper supply, the primary paper supply may be effected at a speed lower than the speed at which the preceding printing paper is conveyed during printing. Further, it is possible to determine the length of the printing paper by rotating the printing drum 30 a plurality of times in advance and control the primary paper supply according to the determined length of the printing paper.

What is claimed is:

1. A stencil printer comprising:

a printing drum which is rotated bearing thereon a stencil master, a press roller which is pressed against the printing drum, a paper supply means which supplies a printing paper to between the printing drum and the press roller so that the printing paper is conveyed pinched between the printing drum and the press roller, and a paper supply control means which controls the paper supply means so that the paper supply means supplies the printing paper to between the printing drum and the press roller at a first predetermined angular position of the printing drum for each rotation of the printing drum, wherein the improvement comprises:

a press roller retracting means that moves the press roller back and forth between an operative position where it is pressed against the printing drum and an inoperative position where it is held away from the printing drum;

a paper length input means that generates a paper length signal representing that the printing paper is an overlong printing paper which is larger than a standard length in a length as measured in the direction of conveyance of the printing paper, and said paper supply control means controls the paper supply means, when the paper length input means generates the paper length signal, so that the printing paper supplied next by the paper supply means does not collide with the paper under printing.

2. A stencil printer as defined in claim 1 in which the paper supply control means inhibits the paper supply means from supplying the next printing paper while the printing paper under printing is being conveyed through the printing drum and the press roller.

3. A stencil printer as defined in claim 2 in which the paper supply control means permits the paper supply means to supply the next printing paper when the printing drum is rotated to said first predetermined angular position after a trailing end of the printing paper under printing passes the printing drum and the press roller.

4. A stencil printer as defined in claim 3 wherein the press roller retracting means moves the press roller to the operative position upon detection of said printing paper exiting said paper supply means and moves the press roller from the operative position to the inoperative position at a second predetermined angular position of the printing drum, and the press roller retracting means does not move the press roller to the operative position while the printing paper is being conveyed through the printing drum and the press roller after printing of the paper has been completed.

5. A stencil printer as defined in claim 1 in which said paper supply means comprises a primary paper supply section which feeds out printing paper from a stack of printing papers at a third predetermined angular position of the printing drum and a secondary paper supply section comprising a pair of timing rollers which supplies the printing paper fed from the primary paper supply section to between the printing drum and the press roller at the first predetermined angular position of the printing drum, and said paper supply control means inhibits the primary paper supply section from feeding out the next printing paper at the third predetermined angular position of the printing drum while the printing paper under printing is being conveyed through the pair of timing rollers.

6. A stencil printer as defined in claim 5 in which the paper supply control means permits the primary paper supply section of the paper supply means to feed out a next printing paper when the printing drum is rotated to said third predetermined angular position after a trailing end of the printing paper under printing passes the timing rollers.

7. A stencil printer as defined in claim 6 in which the press roller retracting means moves the press roller to the operative position upon detection of said printing paper exiting said paper supply means and moves the press roller from the operative position to the inoperative position at a second predetermined angular position of the printing drum, and the press roller retracting means does not move the press roller to the operative position while the printing paper is being conveyed through the printing drum and the press roller after printing of the paper has been completed.

8. A stencil printer as defined in claim 5 in which said paper length input means comprises a paper detecting means which detects whether the printing paper exists near the pair of timing rollers at a predetermined timing, and a signal input means which generates a paper length signal representing that the printing paper is an overlong printing paper when the paper detecting means detects that the printing paper exist near the pair of timing rollers at the predetermined timing.

9. A stencil printer as defined in claim 1 in which said paper length input means comprises:

a paper detecting means which detects whether the printing papers exists near a contact line between the printing drum and the press roller at a predetermined timing, and a signal input means which generates the paper length signal representing that the printing paper is an overlong printing paper when the paper detecting means detects that the printing paper exists near the contact line between the printing drum and the press roller at the predetermined timing.

10. A stencil printer a defined in claim 1 in which said paper length input means comprises:

a paper size detecting means which detects whether the size of printing papers on a paper supply table, and a signal input means which generates the paper length signal representing that the printing paper is an overlong printing paper on the basis of the output paper size detecting means.

11. A stencil printer as defined in claim 1 in which said paper length input means comprises:

a paper size input means for inputting the size of papers to be printed, and a signal input means which generates the paper length signal representing that the printing paper is an overlong printing paper when the paper size input through the paper size input means indicates that the length of the printing papers is longer than the standard length.

12. A printer device comprising:

a printing drum which is rotated bearing thereon a stencil master;

a press roller which is pressed against the printing drum;

a paper supply means which supplies a printing paper to between the printing drum and the press roller so that the printing paper is conveyed pinched between the printing drum and the press roller;

a paper length input means for generating a paper length signal representing that the printing paper is an overlong printing paper which is larger than a standard length in a length as measured in the direction of conveyance of the printing paper;

a paper supply control means which controls the paper supply means so that the paper supply means supplies the printing paper to between the printing drum and the press roller at a first predetermined angular position of the printing drum for each rotation of the printing drum, wherein the paper supply control means controls the paper supply means, when the paper length input means generates the paper length signal, so that the printing paper supplied next by the paper supply means does not collide with the paper under printing; and a press roller retracting means that moves the press roller back and forth between an operative position where it is pressed against the printing drum and an inoperative position where it is held away from the printing drum, wherein the press roller retracting means moves the press roller to the operative position upon detection of said printing paper exiting said paper supply means and moves the press roller from the operative position to the inoperative position at a second predetermined angular position of the printing drum.

13. A printer device comprising:

a printing drum;

a press roller which is pressed against the printing drum;

a paper supply means which supplies a printing paper to between the printing drum and the press roller so that the printing paper is conveyed pinched between the printing drum and the press roller;

means for generating a paper length signal representing that the printing paper is an overlong printing paper which is larger than a standard length in a length as measured in the direction of conveyance of the printing paper;

a paper supply control means which controls the paper supply means so that the paper supply means supplies the printing paper to between the printing drum and the press roller at a first predetermined angular position of the printing drum for each rotation of the printing drum so that the printing paper supplied next by the paper supply means does not collide with the paper under printing; and a press roller retracting means that moves the press roller back and forth between an operative position where it is pressed against the printing drum and an inoperative position where it is held away from the printing drum wherein the press roller is not placed into the operative position while the printing paper is being conveved through the printing drum and the press roller after printing of the paper has been completed.

* * * * *